US007009482B2

(12) United States Patent
Kiko et al.

(10) Patent No.: US 7,009,482 B2
(45) Date of Patent: Mar. 7, 2006

(54) CONTROLLED INDUCTANCE DEVICE AND METHOD

(75) Inventors: Frederick J. Kiko, Carlsbad, CA (US); Charles Watts, Escansido, CA (US)

(73) Assignee: Pulse Engineering, Inc., San Diego, CA (US)

( * ) Notice: Subject to any disclaimer, the term of this patent is extended or adjusted under 35 U.S.C. 154(b) by 116 days.

(21) Appl. No.: 10/381,062

(22) PCT Filed: Sep. 17, 2002

(86) PCT No.: PCT/US02/29480

§ 371 (c)(1),
(2), (4) Date: Mar. 18, 2003

(87) PCT Pub. No.: WO2004/027793

PCT Pub. Date: Apr. 1, 2004

(65) Prior Publication Data

US 2004/0051616 A1 Mar. 18, 2004

(51) Int. Cl.
*H01F 27/02* (2006.01)

(52) U.S. Cl. ..... 336/84 C; 336/84 R; 336/83

(58) Field of Classification Search ..... 336/65, 336/83, 84 R, 84 C, 84 M, 178, 200; 379/399.01
See application file for complete search history.

(56) References Cited

U.S. PATENT DOCUMENTS

| | | | | |
|---|---|---|---|---|
| 1,767,715 A | | 6/1930 | Stoekle | |
| 2,025,093 A | * | 12/1935 | Cotter et al. | 363/47 |
| 2,913,640 A | | 11/1959 | Edgarton | |
| 3,546,571 A | | 12/1970 | Fletcher et al. | |
| 3,551,864 A | * | 12/1970 | Spoldi et al. | 336/83 |
| 3,585,553 A | | 6/1971 | Muckelroy et al. | |
| 4,013,911 A | | 3/1977 | Fujiwara et al. | |
| 4,047,138 A | | 9/1977 | Steigerwald | |
| 4,118,678 A | | 10/1978 | Goshima et al. | |
| 4,138,636 A | | 2/1979 | Liberman | |
| 4,462,016 A | | 7/1984 | Bland et al. | |
| 4,613,841 A | | 9/1986 | Roberts | |
| 4,713,589 A | | 12/1987 | Kashiwagi | |
| 4,833,437 A | | 5/1989 | Williamson | |
| 4,874,990 A | | 10/1989 | Dobnick | |
| 4,989,574 A | * | 2/1991 | Abe | 123/617 |
| 5,003,279 A | | 3/1991 | Morinaga et al. | |

(Continued)

OTHER PUBLICATIONS

Section 6 of the Magnetics Ferrite Cores Design Manual and Catalog (FC-601); Tuning Assembly Dimensions (18 mm ×11 mm); p. 10 of 37; no date; http://www.mag-inc.com/pdf/Pot_RS_DS_Cores.pdf.

(Continued)

*Primary Examiner*—Tuyen T Nguyen
(74) *Attorney, Agent, or Firm*—Gazdzinski & Associates

(57) ABSTRACT

Improved inductive apparatus having controlled core saturation which provides a desired inductance characteristic with low cost of manufacturing. In one embodiment, a pot core having a variable geometry gap is provided. The variable geometry gap allows for a "stepped" inductance profile with high inductance at low dc currents, and a lower inductance at higher dc currents, corresponding for example to the on-hook and off-hook states of a Caller ID function in a typical telecommunications line. In other embodiments, single- and multi-spool drum core devices are disclosed which use a controlled saturation element to allow for selectively controlled saturation of the core. Exemplary signal conditioning circuits (e.g., dynamically controlled low-capacitance DSL filters) using the aforementioned inductive devices are disclosed, as well as cost-efficient methods of manufacturing the inductive devices.

43 Claims, 30 Drawing Sheets

U.S. PATENT DOCUMENTS

| | | | | |
|---|---|---|---|---|
| 5,166,655 | A | | 11/1992 | Rogers |
| 5,281,942 | A | | 1/1994 | Stokes |
| 5,289,359 | A | | 2/1994 | Ziermann |
| 5,350,980 | A | | 9/1994 | Dye et al. |
| 5,351,167 | A | | 9/1994 | Wai et al. |
| 5,359,315 | A | | 10/1994 | Inoue et al. |
| 5,506,560 | A | * | 4/1996 | Takeuchi et al. ..... 336/83 |
| 5,670,925 | A | | 9/1997 | Gibbs |
| 5,770,991 | A | | 6/1998 | Baird |
| 5,939,955 | A | | 8/1999 | Chen et al. |
| 5,952,907 | A | | 9/1999 | McWilliams et al. |
| 6,005,467 | A | | 12/1999 | Abramov |
| 6,087,920 | A | | 7/2000 | Abramov |
| 6,091,211 | A | | 7/2000 | Koga et al. |
| 6,154,028 | A | | 11/2000 | Bushida et al. |
| 6,181,777 | B1 | | 1/2001 | Kiko |
| 6,212,259 | B1 | | 4/2001 | Kiko |
| 6,223,419 | B1 | | 5/2001 | Abramov |
| 6,326,874 | B1 | | 12/2001 | Banzi, Jr. et al. |
| 6,414,583 | B1 | | 7/2002 | Yeh et al. |
| 6,483,412 | B1 | | 11/2002 | Holdahl et al. |
| 6,512,438 | B1 | | 1/2003 | Yoshimori et al. |
| 6,560,851 | B1 | | 5/2003 | Yamamoto et al. |
| 2004/0150500 | A1 | * | 8/2004 | Kiko ..... 336/90 |

OTHER PUBLICATIONS

Section 9 of the Magnetics Ferrite Cores Design Manual and Catalog (FC-601); EP Cores and Accessories (EP7); p. 1 of 5; no date; http://www.mag-inc.com/pdf/ep__cores.pdf.

* cited by examiner (1 OF 2)

(2 OF 2)

(1 OF 2)

(2 OF 2)

(PART 1 OF 2)

(PART 2 OF 2)

CONTROLLED INDUCTANCE DEVICE AND METHOD

This application claims priority benefit of PCT Application PCT/US02/29480 filed Sep. 17, 2002 and entitled "Controlled Inductance Device and Method", which is incorporated herein by reference in its entirety.

BACKGROUND OF THE INVENTION

1. Field of the Invention

The present invention relates generally to components used in electronics applications, and particularly to an improved inductive devices used in, inter alia, filter and splitter apparatus for a digital subscriber line (DSL) or similar telecommunications system.

2. Description of Related Technology

Today, Digital Subscriber Line (DSL) installations are often what is known as "self-install" or specifically where the subscriber installs a micro-filter or in-line phone filters on each telephone to isolate the phones (including faxes, answering machines, etc.) from the line and the DSL signal path. FIG. 1 illustrates a typical installation of such in-line filters.

The self-installable micro-filter is a challenging design, largely because it must have sufficient stop band in the DSL band to protect and preserve DSL performance, but at the same time should also have negligible effect on the voice band performance.

FIG. 1*a* illustrates a typical prior art in-line filter configuration used in DSL applications. Such prior art filter designs, however, often do not satisfy some of the telecom customer's requirements for both return loss and DSL stop band. One significant problem is that the total capacitance required for the DSL stop band requirements also produce excessive side tone in the upper band of the telephones, a highly undesirable result. Furthermore, the return loss problem becomes worse as more micro-filters are added for each of the subscriber's phones.

In certain countries, filter circuit requirements can be stringent. One major challenge, for example, is providing the 30 KHz stop band while providing the very high voice band return loss.

Prior art inductive devices are often not well adapted for use in the foregoing applications, based in large part on their inductance characteristic. As used herein, the term "inductance characteristic" refers generally to the inductance profile, or variation in inductance as a function of dc current through the inductor. FIGS. 2*a* and 2*b* illustrate the inductance characteristics associated with typical prior art inductors having either fixed inductance or variable inductance, respectively. Note that in the typical "fixed" inductor, the inductance characteristic 102 is essentially flat or constant as a function of current, until comparatively high currents are reached. In comparison, the inductance profile of the variable inductor varies as a function of current, either in a substantially linear fashion 106, or in a somewhat "soft stepped" fashion 108, as shown in FIG. 2*b*. FIG. 2*b* is generally representative of the types of prior art device manufactured by, inter alia, Coilcraft Corporation of Cary, Ill., USA, such as the DT1608 Series SMT power inductors.

FIG. 3 illustrates the construction of the aforementioned Coilcraft device. As shown in FIG. 3, the device 300 comprises a two-piece core 302 having a base 304 with an off-centered post 306. The upper core piece 308 has an aperture 310 which is oversized with respect to the diameter of the post 306. This arrangement creates what amounts to a continuously variable gap between the outer surface of the post 306 and the interior surface of the aperture 310, ranging from a minimum gap at the closest point of approach of the two surfaces, to a maximum at the diametric opposite of the point of closest approach. This continuously variable gap has at least two disabilities, including: (i) a continuously variable or "soft stepped" inductance characteristic, which is undesirable or less than optimal in certain applications, and (ii) high cost of manufacturing, since two core pieces with precise relative tolerances must be provided (including precise alignment of the upper core piece 308 with the base 304. Furthermore, there is additional cost associated with manufacturing the "off-center" post 306, irrespective of its tolerances with the other core piece 308. Such off-center arrangement is also not generally conducive to use of well known alignment aids, such as the split-pin arrangement described subsequently herein.

Certain applications, including for example some DSL filter circuits where higher stop band loss is needed (such as for Caller ID functions), require inductive devices with an inductance characteristic different than those of FIG. 2*a* or 2*b*. In the case of the aforementioned Caller ID function, higher stop band loss is needed in the on-hook state to protect the Caller ID device from current overload via the DSL signals. Consider the exemplary filter circuit described in co-pending PCT Application No. PCT/US01/45568 entitled "High Performance Micro-Filter and Splitter Apparatus" filed Nov. 14, 2001 and assigned to the Assignee hereof, which is incorporated herein by reference in its entirety. In this circuit, removal of most of the capacitance during the on-hook state reduces filter stop loss, thereby necessitating an additional or alternate mechanism for increasing the stop loss as previously described.

Similarly, for the exemplary filter circuit described in, inter alia, U.S. Pat. No. 6,212,259 entitled "Impedance Blocking Filter Circuit" and issued Apr. 3, 2001, also assigned to the Assignee hereof, an improved inductive device is needed whereby sufficient inductance is present to allow the circuit to pass the on-hook stop band loss for a plurality of filters, while still allowing a larger off-hook capacitance.

In addition to desirable inductive performance characteristics, low cost of manufacturing for inductive devices is also a highly desirable attribute. Inductive device markets (as well as DSL filter circuit markets) are characteristically quite price competitive; hence, even small improvements in cost efficiency or reductions in pricing of these components can have significant impact on the viability of a manufacturer's product(s). Prior art approaches of controlling device inductance are generally complex (e.g., the "swinging inductance" approach of the aforementioned Coilcraft devices) and dictate comparatively high costs of manufacturing, due to increased labor and/or parts associated with generating the desired inductance characteristic.

Board and interior space consumption is also an issue with many electronic devices (including DSL filter circuits); hence, in addition to the desired performance characteristics and low cost, minimal physical size and footprint is also very desirable. A device which performs well electrically and is inexpensive to manufacture, yet takes up appreciable board or interior space, is often not commercially viable.

ETSI Technical Standard 952, Part 1, Sub-part 5 (ETSI TS 952-1-5) entitled "Access network xDSL transmission filters; Part 1: ADSL filters for European deployment; Sub-part 5: Specification of ADSL/POTS distributed filters" specifies requirements and test methods for DSL distributed filters and distributed filters installed at the Local Exchange side of the local loop and at the user side near the network termination point (NTP). The Standard specifies requirements and test methods for distributed ADSL/POTS distributed filters valid at the user end of the local loop. Per the Standard, on-hook voiceband electrical requirements comprise two conditions: (i) a DC feeding voltage of 50 V, and using the impedance model $Z_{ON}$ (10 kΩ), or (ii) a DC loop current in the range of 0.4 mA to 2.5 mA flowing through the distributed filter; and using an impedance model of 600 Ω to terminate the LINE and POTS port of the distributed filter at voice frequencies. The Standard's on-hook ADSL band electrical requirements may be met with a DC feeding voltage of 50 V, and using the impedance model $Z_{ON}$ (10 kΩ). Off-hook electrical requirements may be met with a DC current of 13 mA to 80 mA. These requirements are comparatively stringent, especially for simple low-cost inductive devices.

Based on the foregoing, an improved inductive device having both low cost of manufacturing and desirable inductance characteristics is needed for use in, inter alia, digital subscriber line (DSL) signals. Such improved apparatus would ideally (i) have the desired inductance characteristics in the on hook and off-hook states, so as to support for example functions such as Caller ID which require higher on-hook stop band loss (ii) be highly cost-effective to manufacture, (iii) be reliable, and (iv) be physically compact in both volume and footprint.

SUMMARY OF THE INVENTION

The present invention satisfies the aforementioned needs by providing an improved inductive device suitable for use in, for example, DSL filter circuit applications, and a method of manufacturing the same.

In a first aspect of the invention, an improved inductive device for use in an electronic circuit is disclosed. The device generally comprises a magnetically permeable core with a controlled saturation element, the core and element cooperating to produce a desired inductance characteristic (e.g., a substantially "stepped" or discrete inductance versus dc current profile). In one exemplary embodiment, the device comprises a substantially cylindrical potentiometer ("pot") core having a first core element and a second core element, with a variable geometry gap formed between at least a portion of the core elements. The variable geometry gap comprises, for example, a first portion having a first gap width and a second, adjacent portion having a second gap width. The variable geometry gap helps control the saturation of the device at various current levels, thereby providing the substantially stepped inductance characteristic in the bands of interest. An integral or separate terminal array is also provided for electrically interfacing the device to external components such as a printed circuit board (PCB).

In a second exemplary embodiment, the improved device of the present invention comprises a unitary or multi-part wound "dual" drum core with first and second end elements, wherein a controlled core saturation element is disposed across all or a portion of the periphery of the drum end elements. The controlled saturation element comprises, in one exemplary configuration, a thin strip of Nickel-Iron (Ni—Fe) tape. By virtue of its ferrous content, this material contains magnetic domains which interact with the magnetically permeable drum core to provide the aforementioned stepped inductance characteristic.

In a third exemplary embodiment, the improved inductive device comprises a "triple" drum core having first and second end elements, as well as a central element disposed between the ends. Ni—Fe tape is used to bridge between at least a portion of the peripheries of the two end elements and the central element.

In a second aspect of the invention, an improved DSL filter apparatus is disclosed. The filter apparatus generally comprises a DSL filter circuit incorporating one or more of the aforementioned inductive devices, thereby being adapted for enhanced stop band performance. In one exemplary embodiment, the filter circuit comprises a dynamically switched filter circuit adapted to reduce shunt capacitance, and thereby allow multiple distributed filters to be used on a given telecommunications circuit without producing undesirably low return loss. The aforementioned pot core and/or dual drum core devices are used to provide increased input inductance during the on-hook state.

In a third aspect of the invention, a circuit board assembly comprising a substrate (e.g., PCB) having a plurality of conductive traces and one or more of the aforementioned inductive devices mounted thereon. In one exemplary embodiment, the aforementioned DSL filter circuit is disposed on the substrate, thereby providing a DSL filter "card" assembly with edge connector.

In a fourth aspect of the invention, an improved method of providing controlled induction using an inductive device is disclosed. The method generally comprises: providing an inductor having a core and a controlled saturation element; selecting the parameters of the controlled saturation element to provide (i) comparatively higher inductance during no-current conditions; (ii) comparatively lower inductance during non-zero current conditions above a given current threshold; and operating the device within a circuit capable of generating no-current and non-zero current conditions through the device. In one exemplary embodiment, the act of selecting the parameters comprises selecting the material, thickness, and geometry of the controlled saturation element in order to control the magnetic saturation thereof.

In a fifth aspect of the invention, a method of manufacturing an inductive component is disclosed. In one exemplary embodiment, the method generally comprises: providing a first core element and a second core element adapted for mating; configuring a first portion of the gap formed between the first and second elements to a first width; configuring a second portion of the gap to a second width; winding the core with conductors; and assembling the first and second elements. In a second exemplary embodiment, the method generally comprises: providing a drum core having first and second end elements and a spool region; winding at least one conductor on the spool region; and bridging the first and second end elements using a controlled saturation element. In a third exemplary embodiment, the method comprises: providing a drum core having first and second end elements, a central element, and at least one spool region; winding at least one conductor on the at least one spool region; and bridging the first and second end elements and the central element using at least one controlled saturation element.

In a sixth aspect of the invention, an improved controlled inductance device (and associated method of manufacturing) is disclosed. The device generally comprises: a magnetically permeable core element; at least one winding disposed on said core element; a cap element disposed substantially around the majority of said at least one winding; and an inductance control element disposed proximate said cap, core element, and said at least one winding. In one exemplary embodiment, the device comprises a vertically oriented drum-type core onto which is would at least one bifilar winding. The drum comprises a base portion which receives a plurality of conductive terminals for mounting to a parent device (e.g., PCB) which are in electrical contact with respective ones of the bifilar windings. The controlled inductance element comprises a nickel (Ni) alloy strip which is disposed substantially within the volume of the cap and captured between the cap and the base portion, thereby providing an additional inductive pathway within the device. The inductance characteristic provided by the exemplary device (i.e., a plurality of notch frequencies) meets or exceeds relevant performance standards, such as the ETSI TS 101 952-1-5 distributed filter specification.

BRIEF DESCRIPTION OF THE DRAWINGS

The features, objectives, and advantages of the invention will become more apparent from the detailed description set forth below when taken in conjunction with the drawings, wherein.

DETAILED DESCRIPTION OF THE PREFERRED EMBODIMENT

Figure 1:
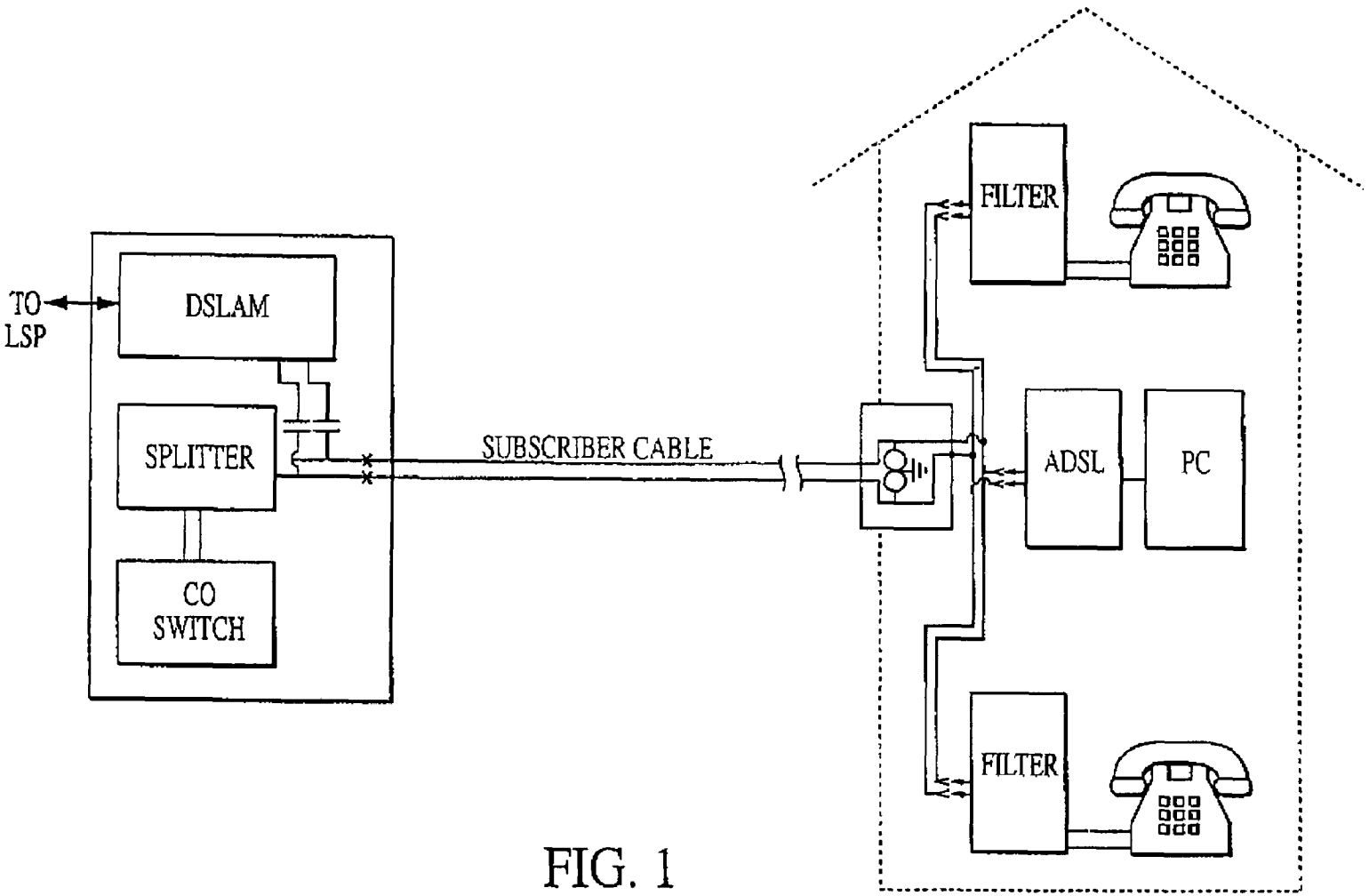
FIG. 1 PRIOR ART
FIG. 1 is a block diagram of a typical prior art DSL installation in a home or small business environment, including prior art micro-filters installed on multiple phone extensions.
Figure 1A:
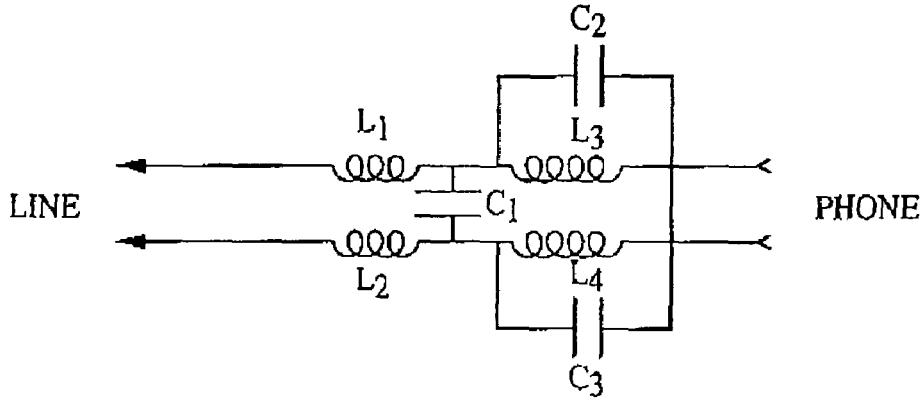
FIG. 1a PRIOR ART
FIG. 1*a* is a schematic of the prior art DSL micro-filters shown in FIG. 1.
Figure 2A:
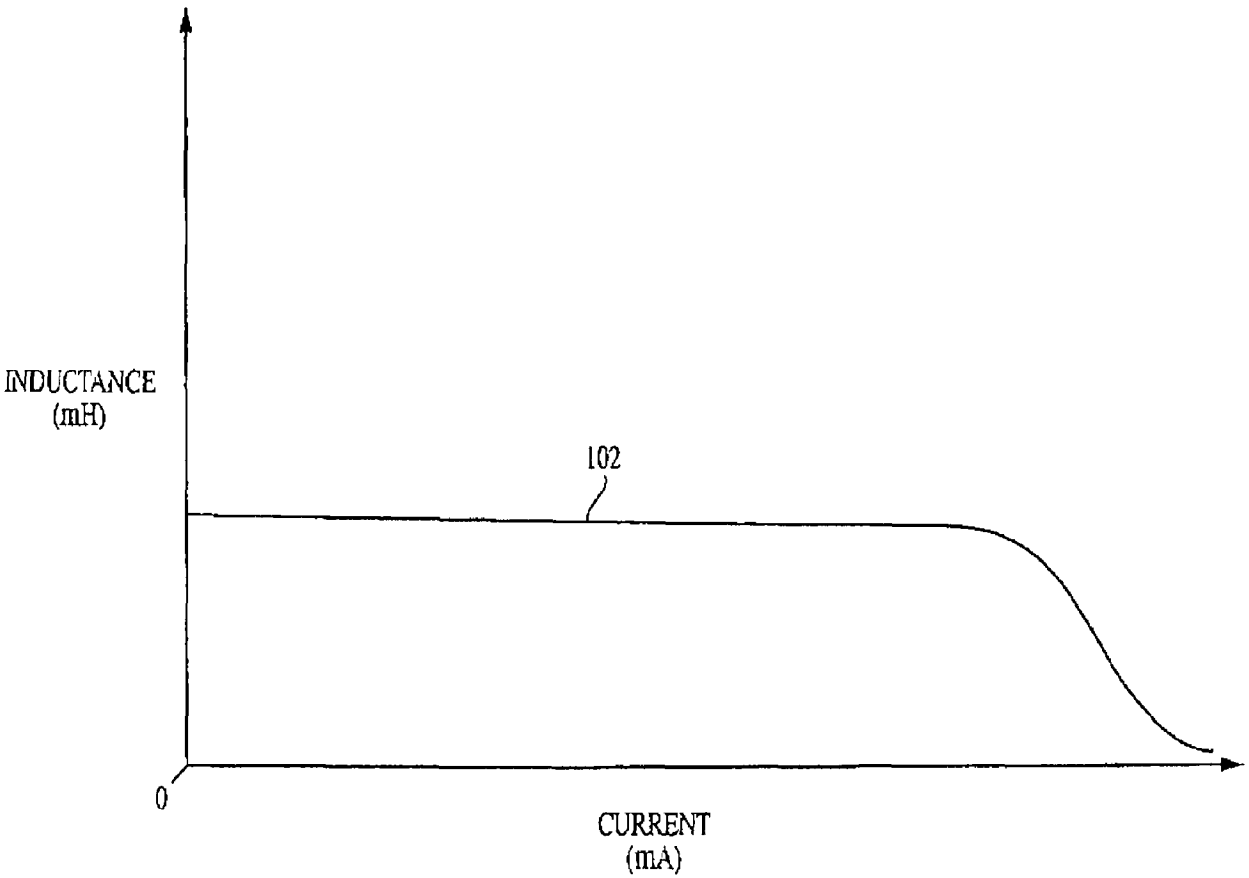
FIG. 2a PRIOR ART
FIG. 2*a* is a graphical representation of the inductance versus dc current characteristic ("inductance characteristic") of a typical fixed inductance prior art device.
Figure 2B:
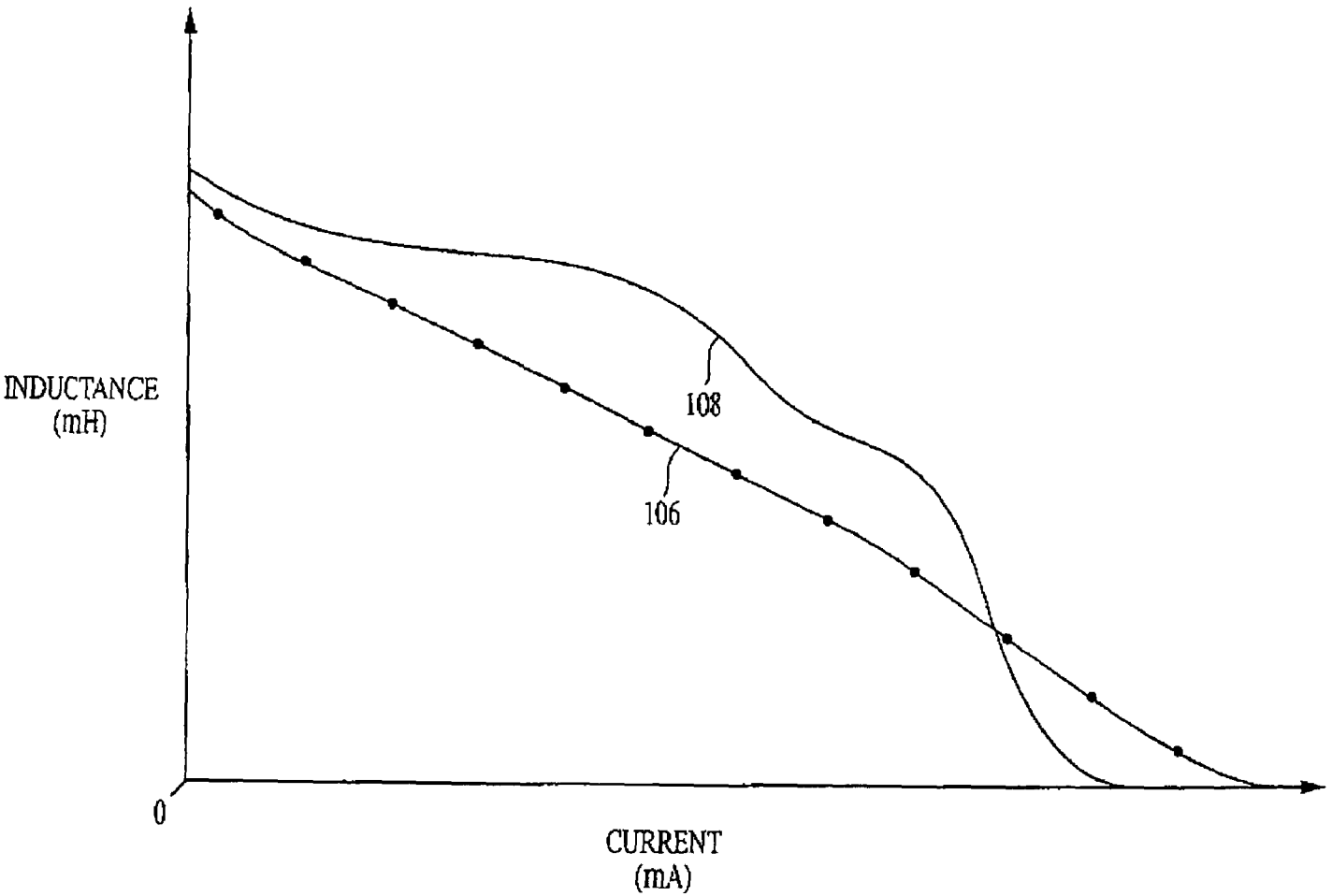
FIG. 2b PRIOR ART
FIG. 2*b* is a graphical representation of the inductance characteristics of typical variable inductance (linear and "soft stepped") prior art devices.
Figure 3:
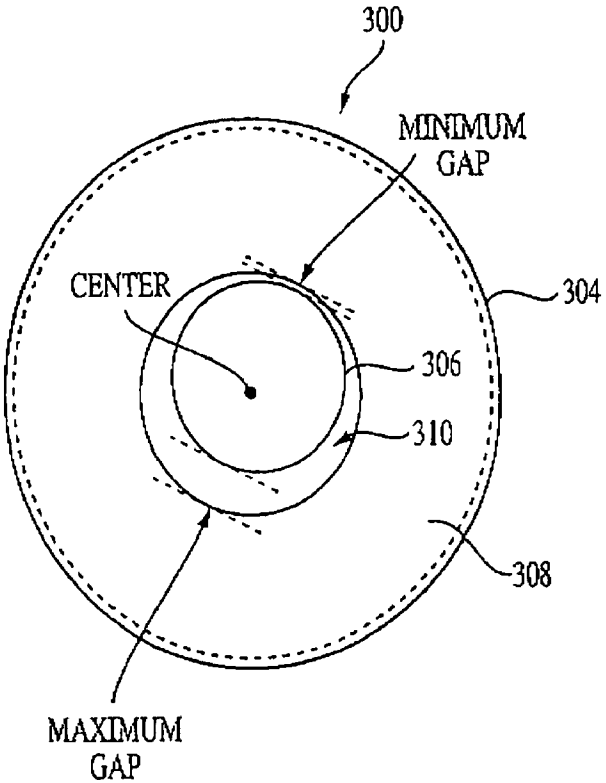
FIG. 3 PRIOR ART
FIG. 3 is top plan view of an exemplary prior art inductive device (Coilcraft) having a varying inductance characteristic.

Reference is now made to the drawings wherein like numerals refer to like parts throughout.

As used herein, the term "signal conditioning" or "conditioning" shall be understood to include, but not be limited to, signal voltage transformation, filtering and noise mitigation, signal splitting, impedance control and correction, current limiting, capacitance control, and time delay.

As used herein, the term "digital subscriber line" (or "DSL") shall mean any form of DSL configuration or service, whether symmetric or otherwise, including without limitation so-called "G.lite" ADSL (e.g., compliant with ITU G.992.2), RADSL: (rate adaptive DSL), VDSL (very high bit rate DSL), SDSL (symmetric DSL), SHDSL or super-high bit-rate DSL, also known as G.shdsl (e.g., compliant with ITU Recommendation G.991.2, approved by the ITU-T February 2001), HDSL: (high data rate DSL), HDSL2: (2nd generation HDSI,), and IDSL (integrated services digital network DSL), as well as In-Premises Phoneline Networks (e.g., HPN).

It will further be recognized that while the terms "home" and "consumer" may be used herein in association with one or more aspects and exemplary embodiments of the invention, the invention is in no way limited to such applications. The present invention may be applied with equal success in, inter alia, small or large business, industrial, and even military applications if desired.

It is noted that while portions of the following description is cast in terms of RJ-type connectors and associated modular plugs of the type well known in the telecommunications art, the present invention may be used in conjunction with any number of different connector types. Accordingly, the following discussion is merely exemplary of the broader concepts.

Additionally, the terms "site" and "subscriber's site" as used herein shall include any location (or group of locations) having telecommunications line service provided thereto, including without limitation residential houses, apartments, offices, and businesses.

Lastly, as used herein, the term "extension device" is meant to include any type of telecommunications device compatible with use on existing telecommunications lines, including without limitation conventional telephones, answering machines, facsimile machines, wireless or satellite receivers, and multi-line phones.

Overview

The present invention in effect solves the problem of being able to cost-efficiently tailor the inductance characteristic of an inductive device to provide two or more substantially discrete inductance values as a function of dc current. In the exemplary context of the home or consumer DSL filter circuit, this substantially discrete characteristic allows for significantly higher input impedance for the filter in the on-hook state. When coupled with a dynamically switched filter circuit, low shunt capacitance and the desired high stop band loss are advantageously provided in a single circuit. The improved inductive devices of the present invention are both cost efficient to manufacture and spatially compact as well.

It is recognized that while the improved inductive device of the present invention is described primarily in terms of use in DSL circuits, such inductive device has application beyond DSL circuits, to include literally any circuit requiring an inductive device having the attributes described herein. Accordingly, the scope of the present invention should be determined with respect to the claims, and not by the exemplary embodiments set forth herein.

Improved Inductive Device

Figure 4:
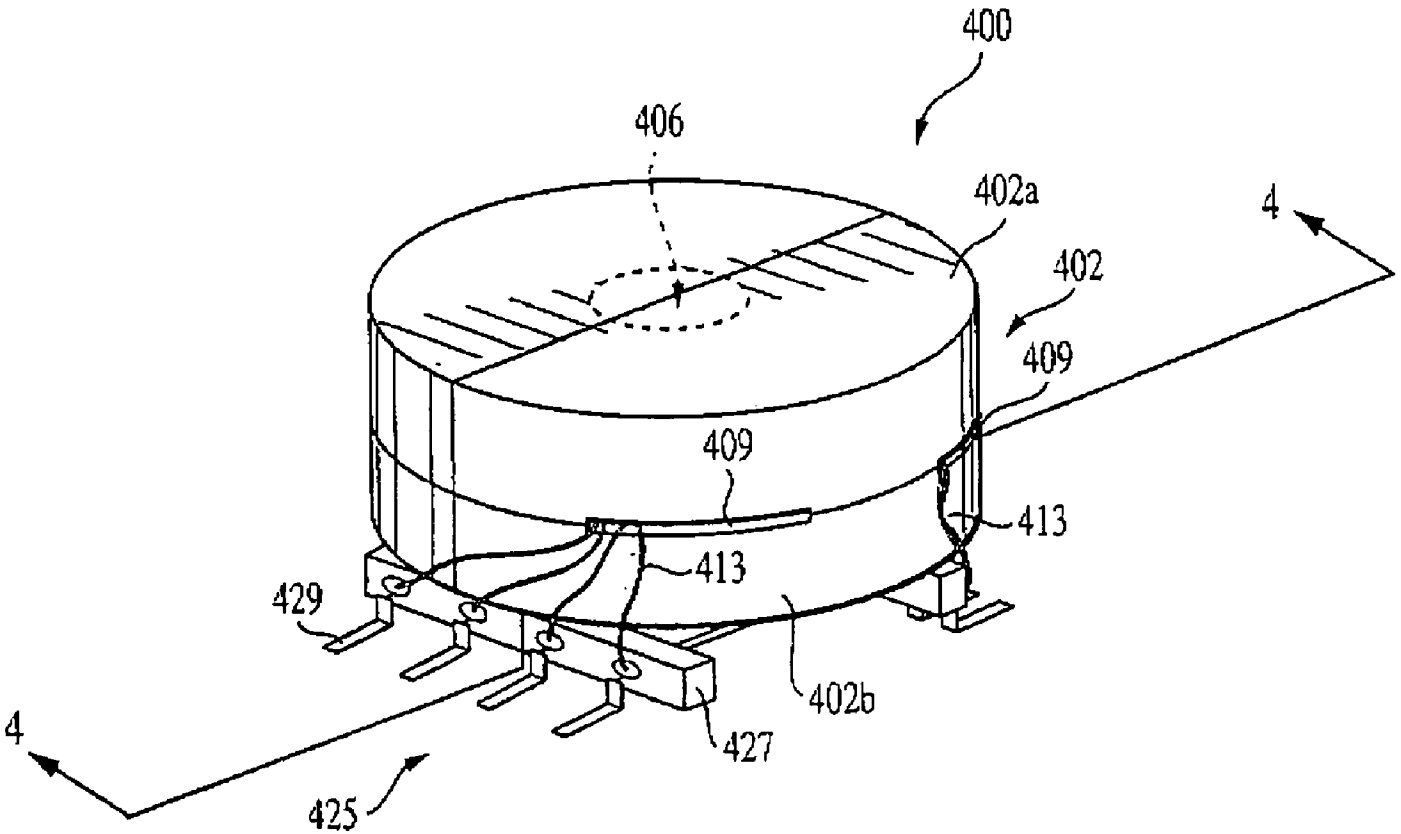
FIG. 4 is a perspective view of a first embodiment of an improved pot core inductive device with controlled saturation according to the invention.
Figure 4A:
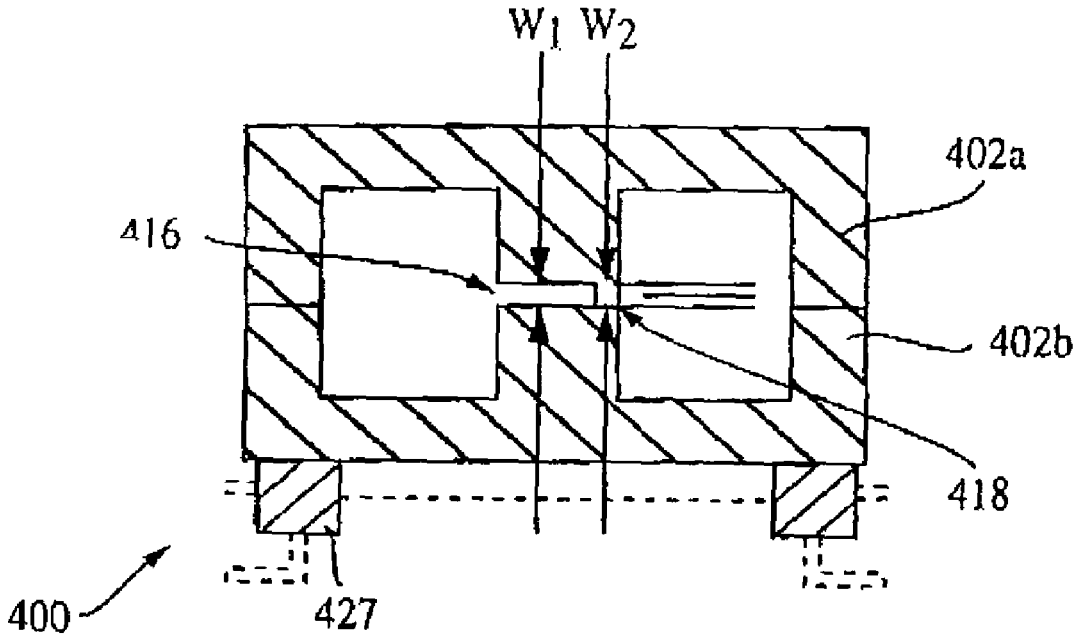
FIG. 4*a* is a side cross-sectional view of the inductive device of FIG. 4, taken along line 4—4.
Figure 4B:
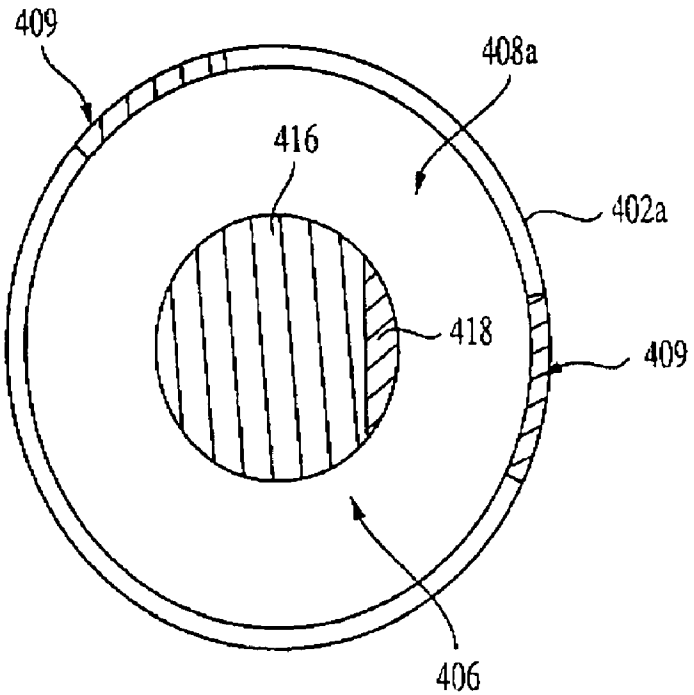
FIG. 4*b* is a bottom plan view of the first core element of the inductive device of FIG. 4, illustrating the variable geometry gap.
Figure 4C:
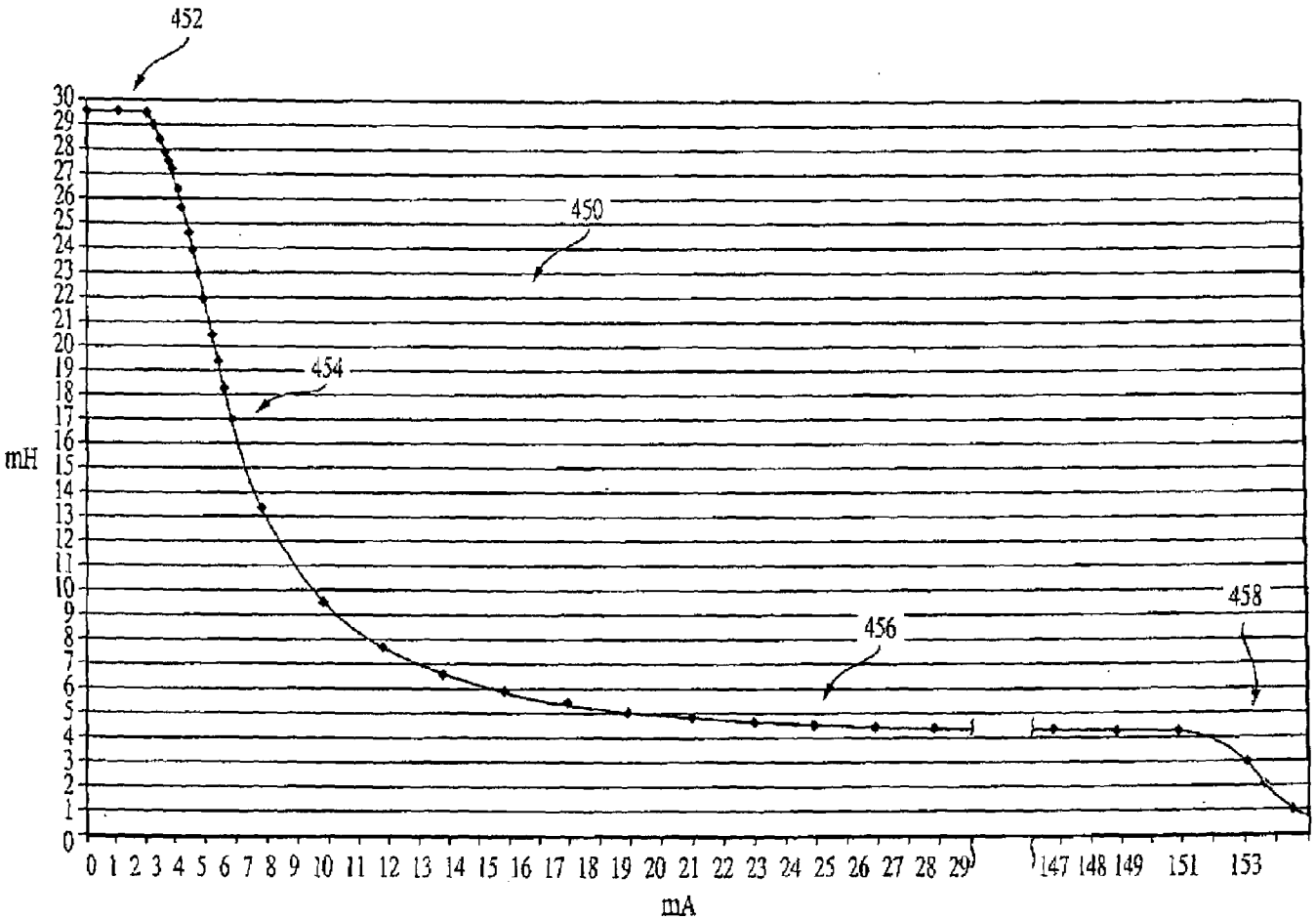
FIG. 4*c* is an exemplary graph of inductance versus dc current for the inductive device of FIG. 4.
Figure 4D:
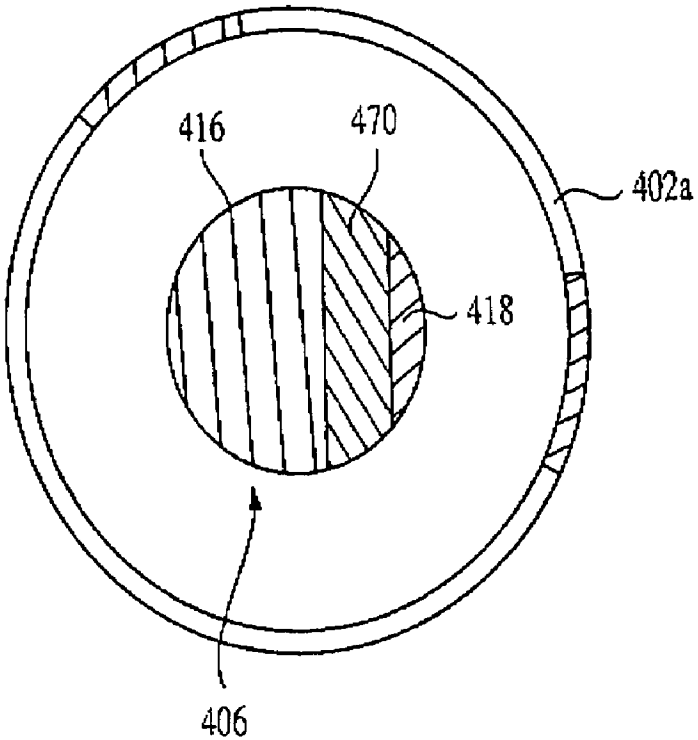
FIGS. 4*d*–4*f* illustrate alternate embodiments of the variable geometry gap of the inductive device of the present invention, illustrating the use of (i) a three-tiered gap; (ii) a concentric two-tiered gap; and (iii) a intermittent concentric two-tiered gap, respectively.
Figure 4E:
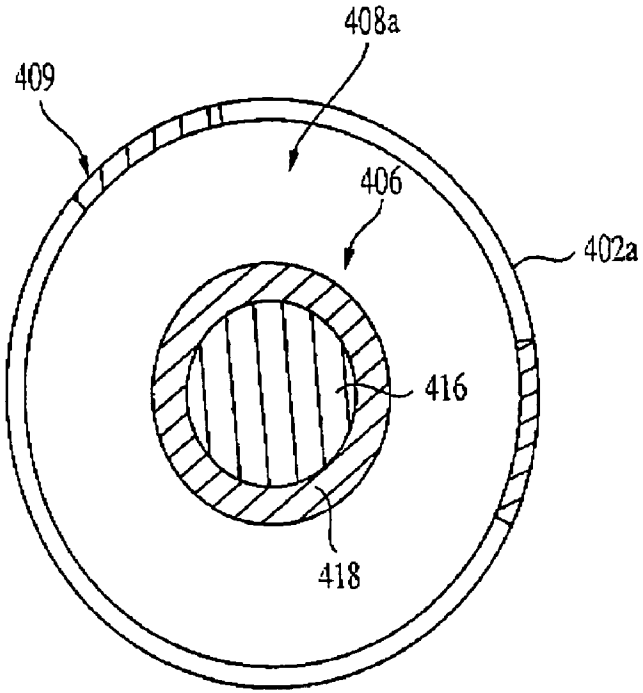
Figure 4F:
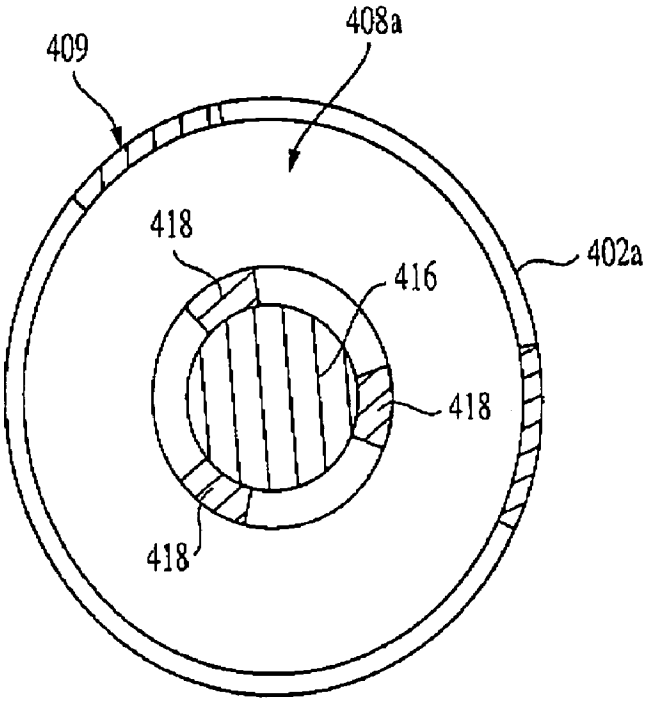

Referring now to FIGS. 4–4*f*, various exemplary embodiments of the improved inductive device of the invention are described in detail. It will be recognized by those of ordinary skill that the embodiments described herein are merely exemplary of the broader concept of providing a controlled saturation inductive device which is both cost efficient to manufacture, and generates a desired inductance characteristic. Many different variations of physical configuration (some of which are described herein) may be employed consistent with the invention.

As shown in FIGS. 4 and 4*a*, a first embodiment of the inductive device 400 is illustrated. In this embodiment, the device 400 comprises generally a potentiometer or "pot" type core 402 having two elements 402*a*, 402*b* designed for mating with one another. The two elements 402*a*, 402*b* are in the present embodiment substantially cylindrical in shape when joined, and each include a centrally disposed post 406*a*, 406*b* around which a channel or recess 408*a*, 408*b* is formed. It will be recognized, however, that other core shapes (including for example the well-known "E" core shape, which is effectively two "E" shapes in mirror image disposition, or the "U" core design) may be utilized consistent with the present invention. The recess 408 provides an interior volume in which the windings of the device 410 are disposed. The elements 402 are each formed from a magnetically permeable material, such as Mn—Zn, as is well known in the electronic arts. Apertures 409 are formed in the sides of the core elements (at the mating joint of the two elements 402*a*, 402*b*) so as to permit conductor ingress/egress. Obviously, other mechanisms for ingress/egress of the conductors may be used, including penetrations through the top or bottom surfaces of the core, etc. Furthermore, certain core shapes (such as the aforementioned "E" core) are open by design, thereby inherently providing egress points for the conductors.

The inductive device 400 also includes one or more electrically conductive windings 413 formed by winding the desired type(s) of conductor around the center post 406 of the core 402. In the exemplary embodiment, so-called "magnet wire" of the type well known in the electronics art is used for both its comparatively low cost and good electrical and mechanical performance. Magnet wire is commonly used to wind transformers and inductive devices, and comprises wire is made of copper or other conductive material coated by a thin polymer insulating film or a combination of polymer films such as polyurethane, polyester, polyimide (aka "Kapton™"), and the like. The thickness and the composition of the film coating determine the dielectric strength capability of the wire. Magnet wire in the range of 31 to 42 AWG is most commonly used in microelectronic transformer or inductor applications, although other sizes may be used in certain applications.

The inductive device 400 of FIG. 4 may also optionally include a terminal array 425 for connection of the aforementioned winding(s) to an external device such as a PCB pad or trace. Inductive devices generally of the type disclosed herein are often disposed on substrates such as PCBs and surface-mounted thereto, advantageously providing a low profile and low cost assembly. The terminal array 425 includes a non-conductive array frame 427 and a plurality of individual substantially flat cross-section terminals 429 which are insulated from each other by the array frame 427. To each or the respective terminals are terminated to the free ends of the inductive device windings 413, such as by soldering and/or wire wrapping into notches formed on the ends of the terminals 429 (not shown). The bottom portions 431 of each of the terminals 429 are adapted for surface mounting (e.g., soldering) to corresponding PCB contact pads (not shown) or other similar conductive counterparts. The core 402 of the inductive device 400 sits atop the frame 427, and may be mounted thereto such as through use of an adhesive on the bottom surface of the second core element 402*b* or any other number of different well known means.

As another alternative, the terminals 429 may be mounted directly into or onto the core 402 (not shown), such by frictionally and/or adhesively embedding them into apertures in the core elements 402*a*, 402*b*, and then terminating the free ends of the windings 413 thereto. Numerous other configurations for terminals and their mounting (either directly or indirectly) to the core 402 exist, such as in the well known ball grid array approaches, or pins (such as used in pin grid arrays), Such alternative configurations being readily recognized by those of ordinary skill.

The region 414 between the facing surfaces 412*a*, 412 of the respective core element posts 406*a*, 406*b* includes a "variable" geometry, the latter designed so as to provide the desired inductance characteristic (described below with respect to FIG. 4*c*). Specifically, in the illustrated embodiment shown best in FIG. 4*a*, this variably geometry comprises two regions 416, 418 disposed between the posts 406, each region having a different gap width ("two-tiered"). The first region 416 has a first gap width $W_1$ which is approximately 0.010 in. (0.254 mm), while the second region 418 has a gap of width $W_2$ which is approximately 0.001 in. (0.0254 mm), which is less than $W_1$. When viewed in plan (FIG. 4*b*), the two regions 416, 418 comprise two adjacent components which form in sum the total cross-sectional area of the posts 406. The first region 416 comprises in the present embodiment about 90% of the total surface area of the cross-section of the post 406, this region being divided from the second region by a chord edge 419. The second region 418 comprises the remaining approximately 10% of the cross-sectional area. In the illustrated embodiment, the gap(s) is/are filled with air; however, it will be appreciated that one or more other materials having desirable properties may be used. For example, the gap may be filled with a high magnetic reluctance compound so as to further control the inductance profile of the core.

Commonly, in DSL filter applications, the series inductor's core(s) must have an air gap to prevent the cores from being saturated by the off-hook dc loop current in the telephone lines. However, there is no dc loop current in the on-hook state. By implementing the multi-region air gap geometry described above, the inductive device of FIG. 4 provides the desired "stepped" inductive characteristic. Specifically, the inductor's on-hook inductance value becomes on the order of 2–10 times larger (depending on the parameters chosen, as discussed below) than the off-hook value. When the particular telephone or other extension device associated with the filter circuit goes off-hook, the width $W_2$ of the second region 418 described above is sufficiently small to allow saturation of the core with the prevailing off-hook dc loop current. This results in the inductance of the device falling to the desired off-hook value. As will be appreciated, the values of $W_1$ and $W_2$, as well as the relative apportionment of the cross-sectional areas of the first and second regions 416, 418 help determine the specific off-hook inductance value, as well as the shape of the "stepped" induction characteristic. In the present context, a two-step characteristic is provided to generate the two desired inductance values (i.e., for on-hook and off-hook states).

FIG. 4*c* illustrates the inductance characteristic 450 associated with the exemplary device of FIG. 4. As shown in FIG. 4*c*, the characteristic has a first portion 452 having a comparatively higher and substantially constant inductance value (at low dc current through the device), a second substantially vertical portion 454 with decreasing inductance as dc current increases, a third portion 456 with comparatively lower inductance at higher dc current (also substantially constant), and a fourth portion 458 wherein the device core is completely saturated. The first portion 452 represents dc current values producing little or no core saturation, and higher inductance corresponding in the exemplary DSL filter circuit to the on-hook condition. During the second portion 454 of the curve 450, the core is beginning to saturate, and there is a sharp (precipitous) drop in inductance with increasing dc current. This sharp drop is related to, inter alia, the increased magnetic flux density through the small gap with increased current saturating this portion which effectively removes it electrically from the circuit. As the dc current is increased even further, the core saturates further, and the device enters the third portion 456 of the curve 450. Here, the inductance is essentially constant with increasing current, until the saturation region 458 is reached. Once complete saturation of the core is achieved, inductance falls off again rapidly to a very small value in comparison to the inductance achieved in the first, second, and third regions 452, 454, 456.

It is noted that while the embodiment of FIG. 4 uses a two-region arrangement for the central post 406, other arrangements may be utilized to produce the desired electrical performance. For example, in one alternative embodiment (FIG. 4*d*), a third region 470 is added to the mating surfaces of the core post 406, thereby adding a third step in the induction characteristic ("three-tiered"). In another alternative embodiment (FIG. 4*e*), the two tiers or regions 416, 418 of the gap area are made concentric to one another, such that the second region 418 with the smaller gap $W_2$ surrounds the first region 416 with the larger gap $W_1$. The thickness $D_1$ of the wall or annulus 474 associated with the second region 418 is controlled to provide the desired inductance characteristic. Furthermore, this wall or annulus 474 may be tapered as a function of vertical height, such that for example its width $D_1$ is smaller nearer the gap $W_2$ than at a point higher above the gap. The annulus 474 can additionally (or alternatively) be made non-continuous; e.g., punctuated with one or more regions along its circumference where the gap is increased, such as by removal of material in these regions as shown in FIG. 4*f*.

The foregoing concentric arrangement also facilitates the use of a central alignment device, such as the split-pin through-hole arrangement described in detail in U.S. Pat. No. 5,952,907 entitled "Blind hole pot core transformer device" issued Sep. 14, 1999 and assigned to Pulse Engineering, Inc., which is incorporated herein by reference in its entirety. This arrangement uses a set of centered apertures formed in the central posts of each of the first and second core elements, and a split friction pin received in one of the apertures prior to assembly of the core. When the core elements are assembled, the free end of the split pin is received within the unobstructed aperture in the other core element, thereby aligning the two core elements precisely.

Myriad other different configurations for the central post 406 are possible, many producing a different inductive performance characteristic. Furthermore, as previously discussed, the variable geometry gap arrangement of the illustrated embodiment may be readily applied to other core configurations, including for example "E" and "U" cores.

It will be recognized that the embodiments of FIGS. 4*a*–4*f* can be manufactured for low cost, since (as described below in greater detail) they can use readily available or "off-the-shelf" low-cost pot cores which are simply modified as described herein to provide the desired inductance characteristic. These devices advantageously require no more space than the traditional pot core, since the variable geometry gap is entirely contained within the interior volume of the device.

Figure 5:
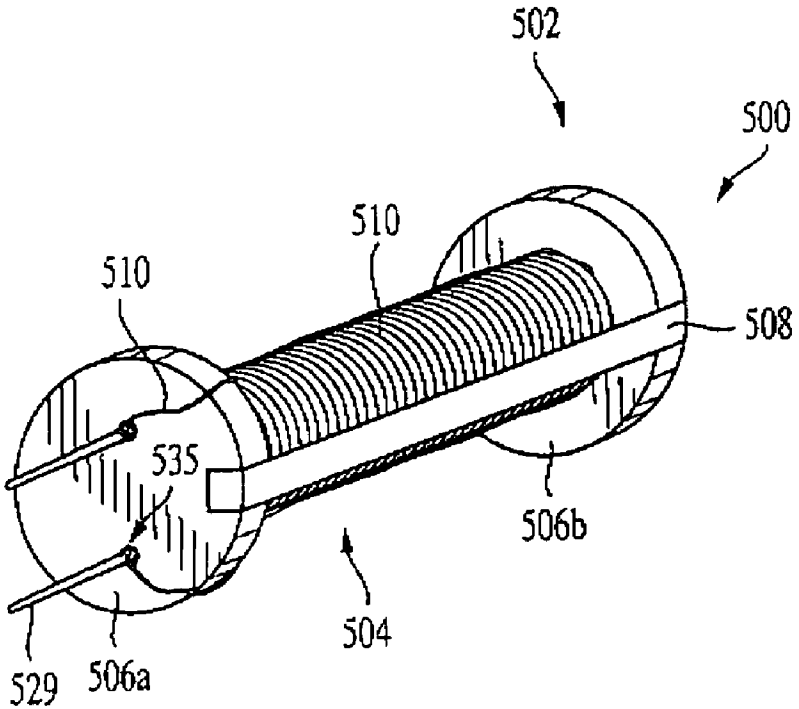
FIG. 5 is a perspective view of a first embodiment of an improved drum core inductive device (single spool) with controlled saturation according to the invention.

Referring now to FIG. 5, a second exemplary embodiment of the improved inductive device of the invention is described. In this embodiment, a drum (or spool) core 502 of the type well known in the art is utilized in conjunction with a controlled saturation element 508. The drum core 502 includes a central spool region 504 as well as two end elements (e.g., flanges) 506*a*, 506*b* disposed on the ends of the spool region 504. The spool region 504 contains the windings 510, which are concentrically wound around the spool. As in the embodiment of FIG. 4, the core 502 is formed from a magnetically permeable material. The core 502 of the illustrated embodiment is one-piece in construction for, among other reasons, reduced cost, although it will be appreciated that a multi-piece core may be substituted.

The controlled saturation element 508 of the illustrated device comprises a thin (approx. 0.001 in., or 0.0254 mm, thick) elongated strip of nickel-iron (Ni—Fe) alloy, which is disposed longitudinally along the core 502 such that it bridges the two end elements 506*a*, 506*b*. The element 508 is in the present embodiment glued or bonded by adhesive to the two end elements 506. Ni—Fe is chosen for the controlled saturation element 508 since (i) it is magnetically permeable (and electrically conductive) due to the ferrous content, and (ii) physically rugged and sufficiently hard due to the Nickel content. The illustrated element 508 has a percentage of 80% Nickel and 20% Iron, although other alloys may be substituted based on the desired properties. For example, different percentages of Nickel and Iron may be used. Alternatively, different types of alloys such as Ni—Fe—Cr (commonly known as Inconel) or so-called "stainless steel" (primarily Fe—C—Cr, whether Martensitic or otherwise) may be used alone or in combination. One advantage of Chromium content is passivation of the element 508, thereby largely mitigating the effects of ferrous degradation mechanisms including iron oxide formation ("rust") and corrosion.

The controlled saturation element 508 may advantageously fabricated as a tape in larger sheets, including the pre-application of adhesive thereto as described in greater detail below, thereby facilitating easy and cost-effective manufacture due to their ready availability.

It will be recognized that the thickness and cross-sectional profile of the controlled saturation element 508 can affect the point at which device saturation occurs, as well as the relative inductance values for different currents. Hence, while an approximately 0.001 in. (0.0254 mm) thick flat strip is used in the illustrated embodiment, other thickness and/or cross-sectional profiles may be used. For example, it may be desirable to utilize one or more substantially round cross-section alloy wires (not shown) as the controlled saturation element(s).

Figure 5A:
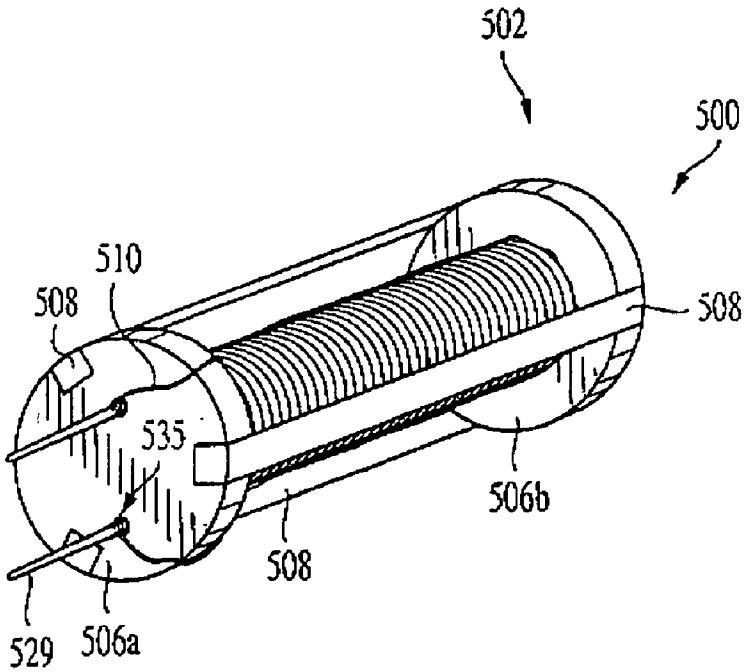
FIG. 5*a* is a perspective view of a first alternate embodiment of the drum core device of the invention having multiple controlled saturation elements.

It will also be recognized that combinations of materials may be used in one or more controlled saturation elements 508 used on a given device. For example, the device 500 may be outfitted with two or more smaller diameter strips 508 disposed around the periphery of the device, thereby bridging the two end elements 506 at multiple locations (see FIG. 5*a*).

Figure 5B:
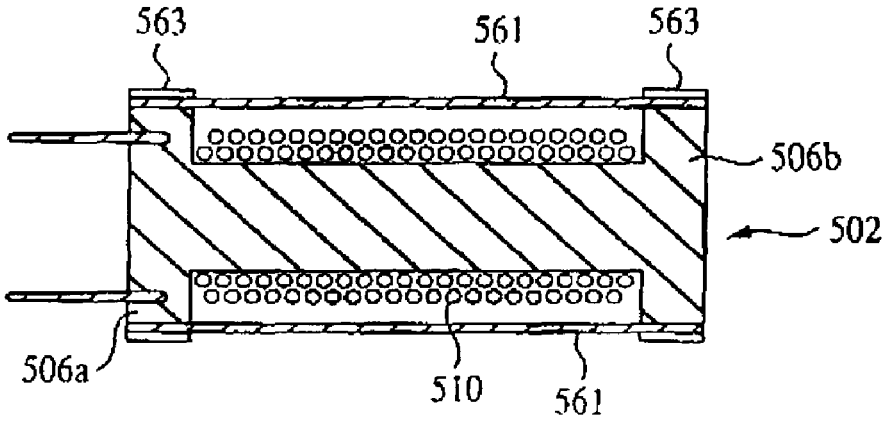
FIG. 5*b* is a cross-sectional view of a second alternate embodiment of the drum core device of the invention having a substantially continuous sheet for the controlled saturation element.

As yet another alternative, the strip 508 shown in FIG. 5 may be replaced with one or more continuous sheets of the alloy "tape" 561 which extend partly or completely around the periphery of each end element 506 (FIG. 5*b*). Heat-shrink tubing 563 of the type well known in the art (such as that manufactured by the Raychem Corporation of Menlo Park, Calif.) may be optionally used in place of or in addition to the aforementioned adhesive for cost-effectively yet permanently bonding the saturation element 508 to the drum core ends 506. Other attachment schemes are possible, including brazing/welding, soldering, clamps, and the like.

As yet another alternative, composite saturation elements 508 may be used, wherein two or more different alloys may be used in conjunction with each other, such as being formed into substantially discrete, side-by-side or over-under strips.

Without the controlled saturation element 508 in place, the inductance of the core 502 (and the device as a whole) is primarily determined by the air gap between the end elements 506. However, with the saturation element 508 in place, the air gap between the ends 506 is bridged, thereby substantially increasing the inductance of the device 500 in the low or no-current condition (e.g., on-hook). However, when the extension device to which the inductive device 500 is connected goes off-hook, the dc current increases, thereby increasing the flux density in the comparatively thin element 508. This causes the element 508 to rapidly saturate, thereby substantially reducing the inductance of the device ("step").

The inductive device 500 of FIG. 5 may also optionally include a terminal array such as that described with respect to FIG. 4 above for connection of the aforementioned winding(s) to an external device such as a PCB pad or trace. Alternatively, the terminals 529 may be mounted directly into or onto the core 502 (as shown), such by frictionally and/or adhesively embedding them into apertures 535 in the core element 502, and then terminating the free ends of the windings 413 thereto. See also the alternate embodiment of FIG. 5*c*, wherein the drum core contains recesses 588 which are adapted to receive L-shaped terminals 586. The free ends 580 of the device windings 513 are disposed within the recesses 588 to allow electrical termination to the terminals 586. Numerous other configurations for terminals and their mounting (either directly or indirectly) to the core 502 exist, such as in the well known ball grid array approaches, or pins (such as used in pin grid arrays). Such alternative configurations being readily recognized by those of ordinary skill.

Figure 5C:
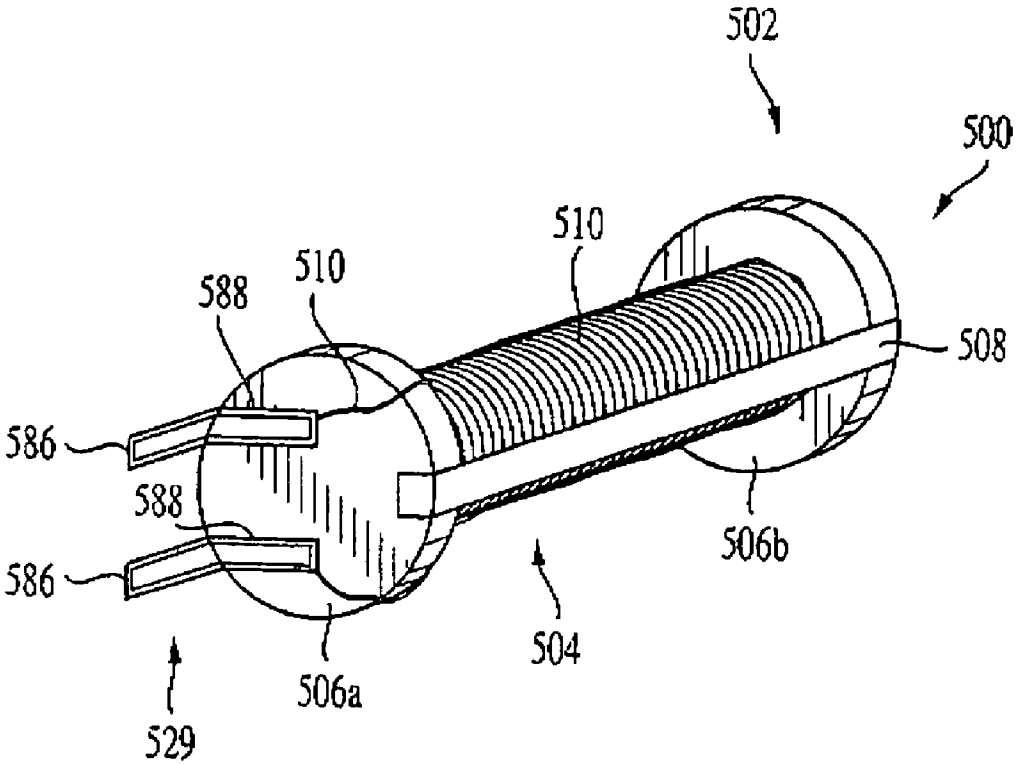
FIG. 5*c* is a perspective view of a third alternate embodiment of the drum core device of the invention having L-shaped terminals adhesively mounted within the drum core.

As with the embodiment of FIG. 4, the inductive devices of FIGS. 5–5*c* are highly cost efficient to manufacture, owing in large part to the simplicity of the arrangement used for controlling the device's inductance profile. This distinguishes over more complex (and costly) prior art arrangements for providing tailored inductance characteristics.

Figure 6:
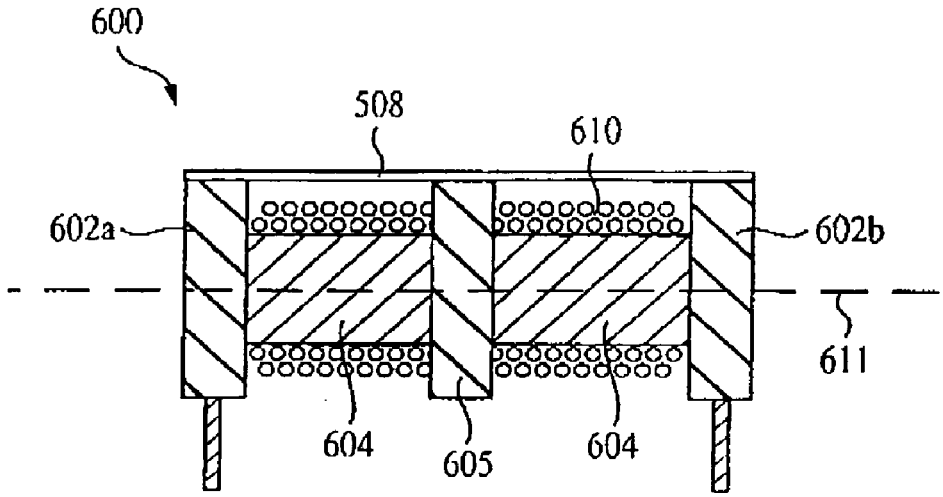
FIG. 6 is a perspective view of a first embodiment of an improved drum core inductive device (multi-spool) with controlled saturation according to the invention.

Referring now to FIG. 6, yet another embodiment of the improved inductive device of the invention is described. In this embodiment, the device 600 comprises a dual drum core 602 having first and second end elements 602*a*, 602*b* and a central element (e.g. flange) 605 disposed between the two end elements 602. Two spool regions 604 are provided to each contain one or more sets of concentrically wound windings 610. A unitary controlled saturation element 608 is disposed longitudinally along the axis 611 of the device and in contact with each of the three elements 602*a*, 602*b*, 605, thereby bridging the two air gaps formed there between.

It will be recognized, however, that two discrete saturation elements 608 (not shown) may be used to bridge the two air gaps of the dual-spool core 602. Furthermore, the various alternate configurations described above with respect to the single-spool drum core of FIG. 5, such as use of different alloys, continuous tape, multiple saturation elements, etc., may be equally applied to the dual-spool core of FIG. 6.

Filter Circuit Description

Figure 7:
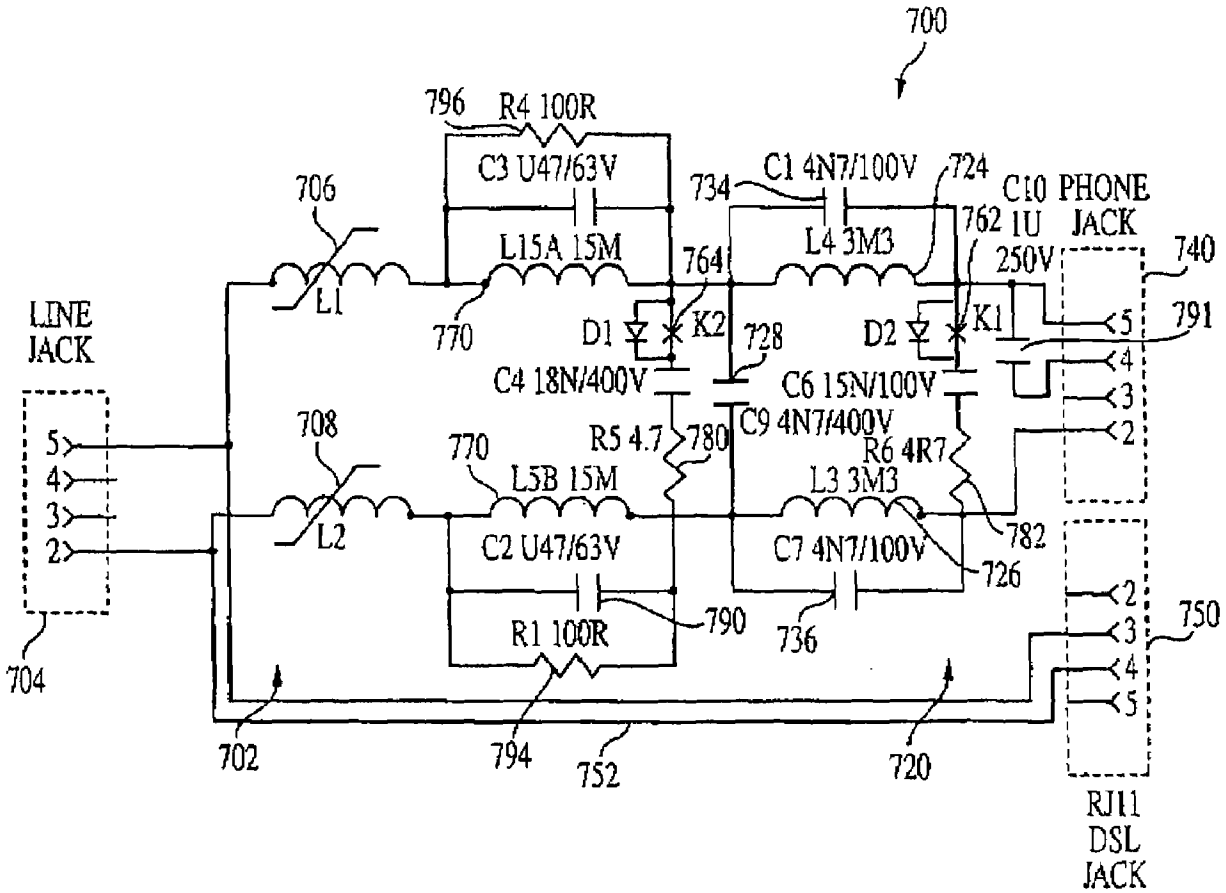
FIG. 7 is a schematic diagram of a first exemplary filter circuit using the improved inductive device of the invention.
Figure 8:
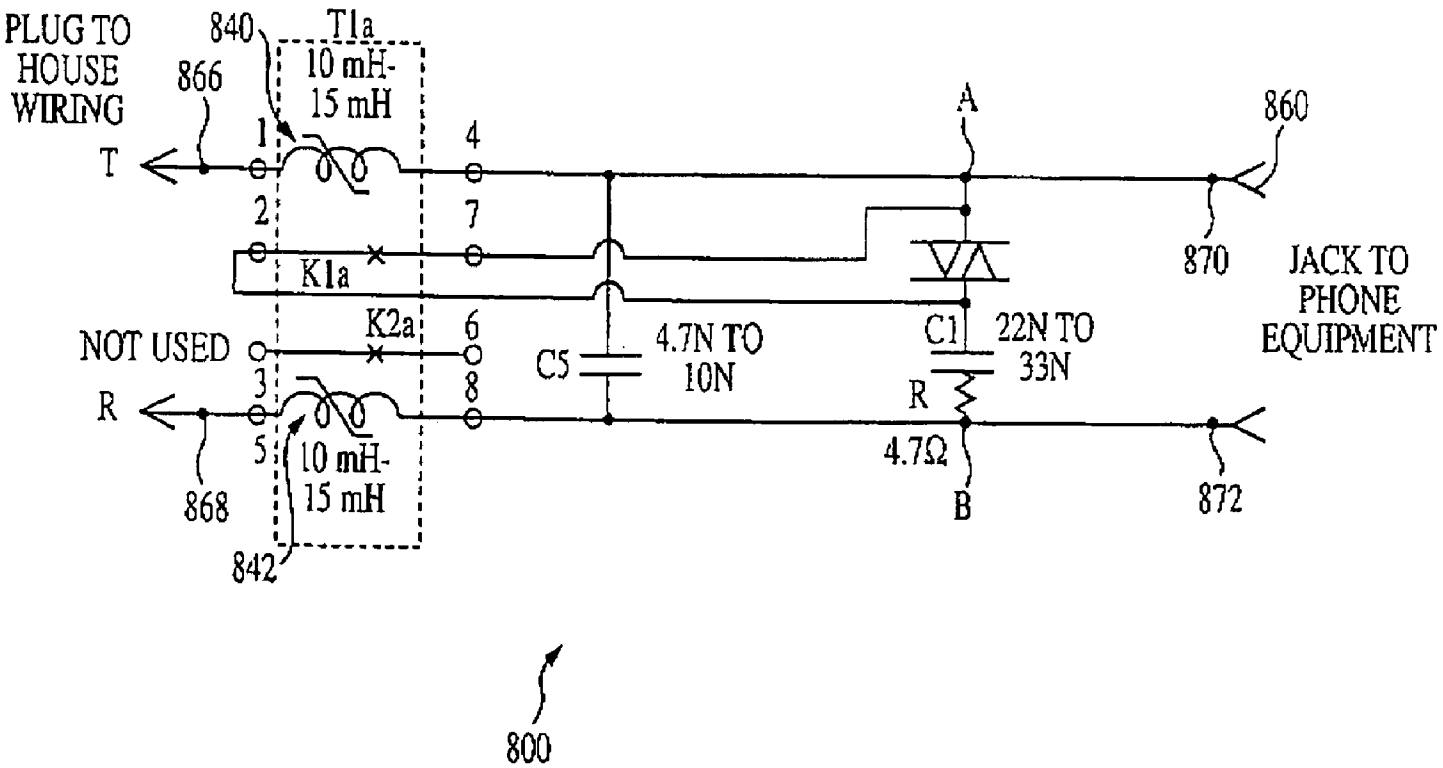
FIG. 8 is a schematic diagram of a second exemplary filter circuit using the improved inductive device of the invention, utilizing the dual-spool drum core device of FIG. 6.
Figure 9:
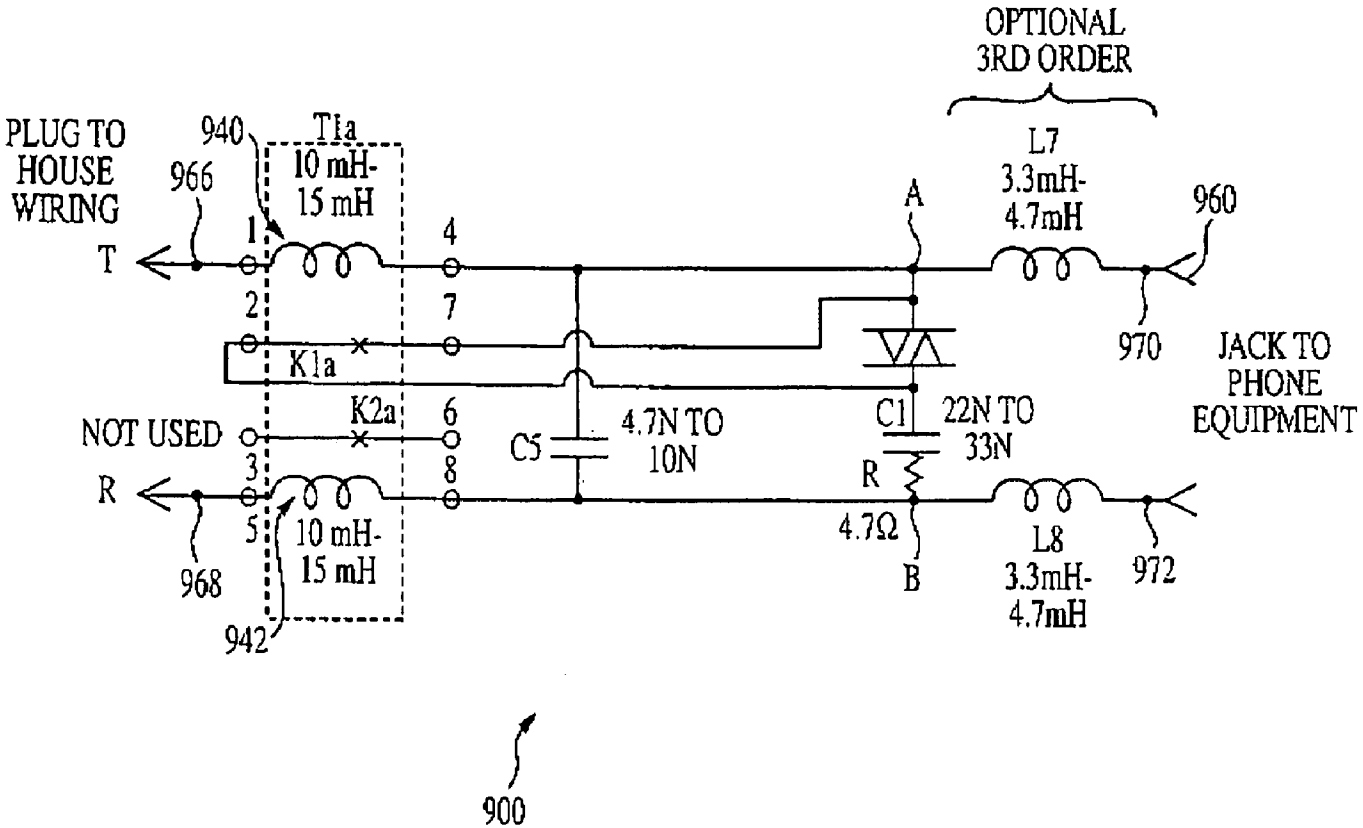
FIG. 9 is a schematic diagram of the filter circuit of FIG. 8, including optional third-order filter.

Referring now to FIGS. 7–9, improved filter circuits utilizing the above-described inductive device(s) are disclosed. As previously discussed, the inductive device of the present invention solves the problem of being able to cost-efficiently tailor the inductance characteristic of an inductive device to provide two or more substantially discrete inductance values as a function of dc current. In the exemplary context of the home or consumer DSL filter circuit, this substantially discrete characteristic allows for significantly higher input impedance for the filter in the on-hook state. When coupled with the dynamically switched filter circuits such as that depicted in FIG. 7, low shunt capacitance and the desired high stop band loss are advantageously provided in a single circuit. Stated differently, the improved inductor of the present invention, when combined with the dynamic filter circuit of FIG. 7, provides for a single filter circuit which provides a low impedance filter in the off-hook state and a high impedance filter in the on-hook state, yet advantageously maintains the same (or similar) frequency cutoff performance. Hence, synergies are created through the combination of these two elements (i.e., the "stepped" inductive devices and the dynamically switched filter circuits). When the inductive device of the present invention is combined into the filter circuit(s) of FIGS. 8 and 9, excellent stop band performance is provided at extremely low cost, through among other things the use of the combined or dual-spool inductor of FIG. 6.

Referring now to FIG. 7, a first embodiment of the dynamic micro-filter configuration with improved inductive devices is described. It will be appreciated that while the embodiment of FIG. 7 comprises an exemplary design adapted to meet the requirements for use in countries with certain performance requirements such as the United Kingdom (UK), the dynamic filter of the present invention may be adapted for use in literally any application, through proper component selection and configuration. Such alternate applications and adaptations are readily determinable to those of ordinary skill based on the present disclosure, and accordingly are not described further herein.

It will further be appreciated that while the following discussion is cast in terms of a plurality of discrete electrical components (i.e., resistors, inductors, capacitors, switches, etc.) used to form a circuit, portions of the circuit may be rendered in the form of integrated components (such as integrated circuits) or other types of components having the desired functionality and electrical performance.

As shown in FIG. 7, the filter circuit 700 generally comprises an input section 702 having a plurality of input terminals (line side jack) 704 and two input inductors 706, 708. These two input inductors 706, 708 each comprise in the present embodiment an controlled saturation inductor of the type previously described herein. This provides the circuit with desired input inductance characteristic previously discussed. An output section 720 comprises two additional inductors 724, 726 (L3, L4) and three capacitors 727, 228, 730 (C4, C9, C6). The filter's input "stepped" inductors (L1, L2) 706, 708 are connected to the line side jack 704, while the filter's capacitive output section 720 is connected to the filter's phone side jack 740. The line and phone side jacks 704, 740 a modular jack of the type commonly used in telecommunications applications, although it will be recognized that other types of modular plugs and connectors may be substituted. The filter 700 further includes a DSL jack 750 that, in the illustrated embodiment, comprises and RJ-11 type DSL jack, although others may be substituted as well. The DSL jack 750 passes directly via electrical pathways 752 to the line side jack 704 (or plug) to provide a convenience DSL or home phone network (HPN) jack.

The basic filter provided by the circuit of FIG. 7 is a fourth-order elliptical low pass filter that consists of the two input inductors 706, 708 (L1, L2), two output section inductors 724, 726 (L3, L4), and three bridge capacitors 727, 728, 730 (C4, C9, and C6, respectively). The input inductors 706, 708 provide the required input inductance characteristic and prevent loading on the DSL circuit, while the two capacitors 734, 736 (C1, C7) in the output section 720 are added to the output inductors 724, 726 (L3, L4) to produce a resonance on the order of 30 KHz, although it will be appreciated that other reactance and capacitance values can be selected in order to obtain other resonance frequencies. Accordingly, the embodiment of FIG. 7 is a fourth-order elliptical filter which produces a sharp 30 KHz cut-off. The elliptical stop band feature allows the design to minimize the total capacitance to typically <40 nF off-hook and 5 nF on-hook (i.e., <40E−09 Farad off-hook, and 5E−09 Farad on-hook), which minimizes the effect of the capacitance on the phone's voice band performance.

To make the filter 700 dynamic and allow for self-installation by the subscriber for multiple filters for each telephone, two reed switches 762, 764 (K1, K2) are added to remove most of the filter capacitance for the on hook (idle) phones. Both of the reed switches 762, 764 are, in the embodiment of FIG. 7, magnetically coupled to the dual inductor 770 (L5A), as described in U.S. Pat. Nos. 6,181,777 and 6,212,259 entitled "Impedance Blocking Filter Circuit", issued Jan. 30, 2001 and Apr. 3, 2001, respectively, and assigned to Assignee hereof. Specifically, the reed switches 762, 764 are coupled to a dual inductor 770 by virtue of their physical proximity to the windings of the inductor, and therefore the magnetic field generated thereby.

The inductor/reed switch device 766 of the present embodiment is formed of cylindrical housing and contains the dual inductor and the two reed switches 762, 764. It should be apparent to those skilled in the art that the dual inductor/reed switch device 766 can be replaced with two single inductor/switch units (not shown) so as to render the same functionality. In the illustrated embodiment, the reed switches 762, 764 are disposed horizontally with their longitudinal axis substantially parallel with that of the bobbin of the device. This configuration provides the aforementioned magnetic coupling between the windings of the inductor 770 and the switches to operate the latter. The device 766 is selected to be actuated on a predetermined loop current threshold (e.g., approximately 6–16 mA). If the loop current threshold is too low, the reed switch(es) may chatter during operation of the circuit, and may thus shorten the useful life of the switch(es). On the other hand, if the loop current threshold is too high, then the amount of loop current may be insufficient to actuate the switch(es) in the worst case condition.

When no loop current flows (because the phone is on hook), there is no magnetic field from the dual inductor 770 and the reed switches 762, 764 are open, which removes the capacitors 727, 730 (C4 and C6) from the circuit. This reduces the total capacitance for each on hook filter from approximately 37.7 nF to only 4.7 nF in this embodiment. The 4.7 nF value is the minimum capacitance necessary to force any on hook phone resonance below 30 KHz. Additionally, to protect the reed switches 262, 264 from the ringing voltage, power cross-voltages and lightning induced transient voltages, one or two Zener diodes 776, 778 (D1, D2) are included across the reed switches 762, 764 as shown in FIG. 7 to clamp the peak voltage to below 12 V. The single diodes 776, 778 of the illustrated embodiment work satisfactorily because the capacitors are in series with the diodes, and will self bias the single diode when AC signals are present. Alternatively, however, the foregoing diode arrangement may be replaced dual back-to-back 6–12 V Zener diodes, a single Zener diode, or even low capacitance varistors. The construction and selection of such components, consistent with the present aims of providing the minimum capacitance in the device, are well known in the electronics arts, and accordingly are not described further herein.

To protect the reed switches 762, 764 from switching current spikes through the C9 capacitor 728 and the C4 capacitor 727 (and the C1, C7 capacitors 734, 736) when the reed switches close, two resistors 780, 782 (R5, R6) are added in series with the C4 and C6 capacitors 726, 730 to limit the switching current to below the maximum current ratings of the switches. The resistance values of R5, R6 are chosen low enough so as not to significantly affect the filter's stop band performance.

The foregoing dynamic components of the filter 700 are collectively insufficient to provide enough return loss improvement to meet the stringent requirements previously discussed (e.g., those of the European/UK Specifications). To address this issue, the resonant impedance correction circuit made from the dual inductor 770 (L5A, L5B), parallel network capacitors 790, 792 (C2, C3), and parallel network resistors 794, 796 (R4, and R1) further improves the voice band return loss up to 10 db by adding a positive phase impendence in the 2–3 KHz band. The dual inductor 770 (L5A, L5B) performs a dual purpose; in addition to driving the reed switches during off hook as previously described, the dual inductor 770 (in combination with the network capacitors C2, C3 790, 792) forms a differential resonance impedance in series with the line input. The parallel network resistors 794, 796 (R3, R4) limit this impedance to approximately 700 ohms at resonance, which limits the maximum insertion loss to an acceptable level (i.e., on the order of 2 db).

The circuit 700 of FIG. 7 is further provided with a 1 microfarad ringing capacitor 791 (C10) across pins 4 and 5 of the phone jack 740. Filters used in certain (e.g., UK) applications require such a capacitor for ringing some three-wire phone installations. It will be recognized, however, that this capacitor is optional depending on the particular application in which the filter circuit of the invention is used.

It is further noted that the circuit 700 embodiment of FIG. 7 advantageously uses separate inductive coils for the various circuit inductors 706, 708, 724, 726 (L1, L2, L3, L4) rather than, for example, the dual EP13 style inductor typically used in many prior art designs. This arrangement provides a longitudinal blocking impedance as well as differential impedances, which some applications (including for example, European telecommunications specifications) require. Traditional EP-based designs have effectively no longitudinal impedance, so an additional coil may be required. The additional coil adds extra dc resistance, and to compensate for the added resistance, larger coils are often required, thereby increasing the cost and space requirements associated with the filter. In contrast, with the separate coils design of the present invention, it is not necessary to add a longitudinal coil or increase the size of the filter's inductors. In the illustrated embodiment, the use of controlled saturation inductors and/or dual bobbin, dual shielded inductors such as those manufactured by the Assignee hereof can provide the aforementioned longitudinal impedance as well as providing magnetic field to drive the reed switches (as applicable).

The dynamic filter circuit 700 disclosed herein is meant to address inadequate stop band and voice band performance on telecommunications lines by providing (i) a "dynamic" filter configuration which can change states dependent on the operating condition of the associated extension devices; and (ii) an impedance correction circuit which provides, inter alia, enhanced return loss performance. Specifically, in the case of a telecommunications line having voice and DSL signal components, when one of the phones on the line goes off-hook (typically only one of the phones are off hook at any one time), the dynamic circuitry of the off-hook filter increases its capacitance, while all the other on-hook phones on the same line remain at a low capacitance relative to the off-hook circuit. This dynamic capacitance feature is acceptable and compatible with existing applications, since the primary need for the enhanced DSL stop band corresponds to the off-hook phone, and the presence of the phone's polarity guard diode bridge. The DSL high-level up stream energy can over-drive this diode bridge in the off-hook phones, and accordingly produce unwanted inter-modulation distortion. Therefore, enhanced DSL stop band is needed to prevent such over-drive condition. When the phone or other extension device is on-hook, the diode bridge is removed from the circuit, and less filter DSL stop band attenuation is required. Very little capacitance can therefore be employed in the filter circuits associated with the on-hook phones. This allows the off-hook phone to have a comparatively larger capacitance, and thus the dynamic filter can have near splitter performance.

It will be recognized, however, that removing most of the capacitance during the on-hook state also reduces the stop loss, which can be problematic for certain operating states which require increased on-hook stop band loss (e.g., Caller ID). The incorporation in the circuit 700 of the controlled saturation inductive devices 400, 500 of the present invention advantageously addresses this problem, however, by increasing the filter's input inductance values only in the on-hook state; i.e., by providing a "stepped" inductance versus dc current characteristic. Therefore, the combination of the dynamically switched filter circuit and the controlled saturation input-side inductors provides near ideal performance in a broad range of applications (including multi-extension applications with Caller ID or similar functions) with very low cost.

Referring now to FIGS. 8 and 9, yet other embodiments of the filter circuit with improved inductive device is described. The circuit 800 of FIG. 8 comprises a line or input side having inputs 866, 868 connected to two respective input inductors 840, 842. The exemplary circuit 800 of FIG. 8 utilizes a dual-spool inductive device such as that of FIG. 6 herein to provide these two inductances 840, 842, although a different configuration (such as two single-spool drum core devices 500) may be substituted. The higher inductance provided by the dual-spool inductive device 600 advantageously produces sufficient inductance to allow the filter 800 to pass the on-hook stop band loss for more than 10 filters while allowing a larger off-hook capacitance to improve the stop band (such as for Caller ID or other functions requiring such higher stop band), yet still meeting the return loss requirements. Use of the dual-spool device 600 in place of the inductors 840, 842 provides significant cost benefits as well, since it is generally significantly less costly to manufacture the dual-spool device as opposed to two single-spool components. Furthermore, the circuit of FIG. 8 is extremely simple to make, requiring only two inductors 840, 842 (i.e., one dual-spool inductor), thereby allowing for a highly cost-efficient circuit with excellent stop band and filter performance.

The circuit 900 of FIG. 9, like that of FIG. 8 described above, comprises a line or input side having inputs 966, 968 connected to two respective input inductors 940, 942, yet also includes an optional third-order filter circuit disposed in communication with the external-side jacks 960, 972. Such third order filter component may be desirable in certain circumstances.

Method of Manufacturing

Figure 10A:
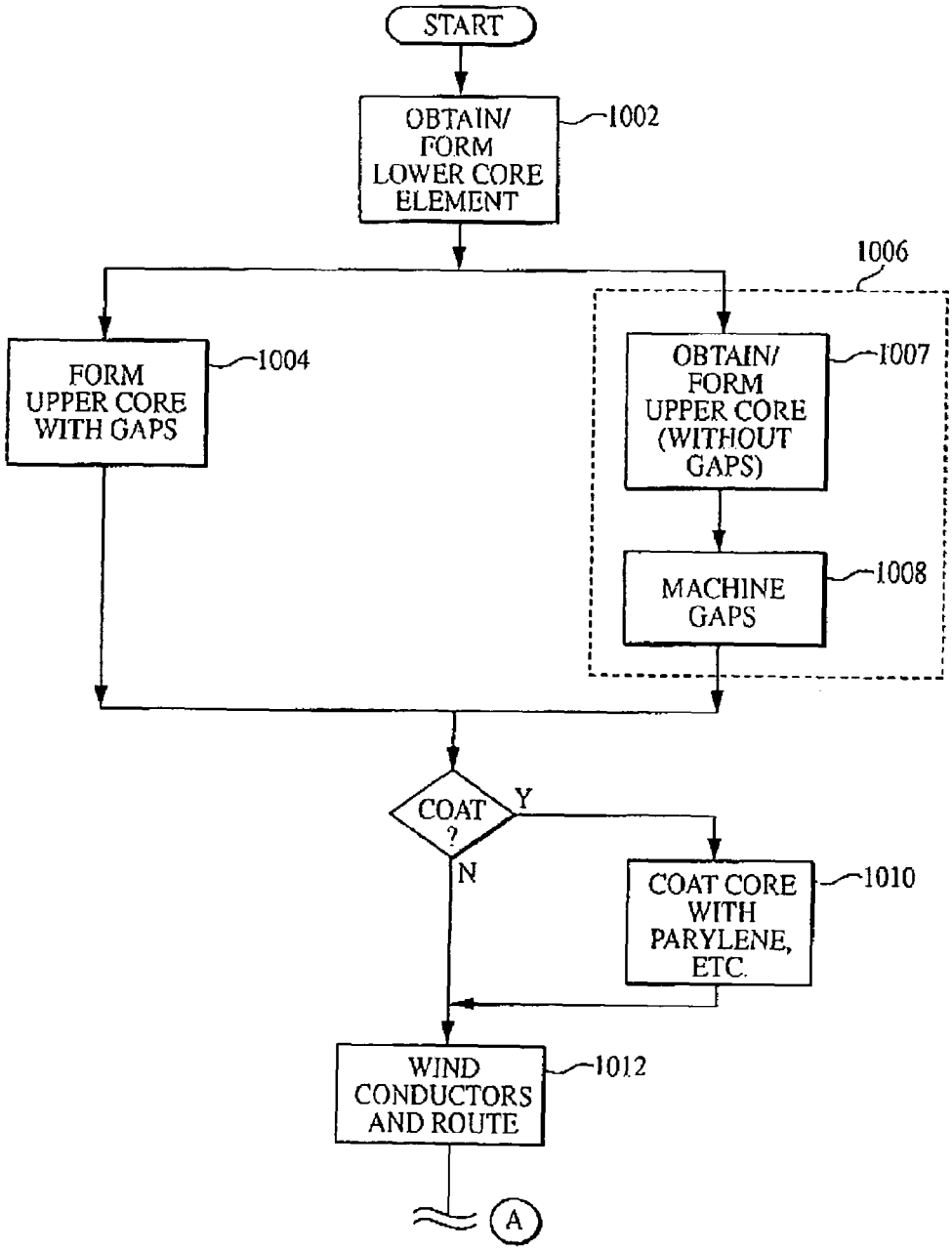
FIG. 10*a* is a logical flow diagram illustrating an exemplary method of manufacturing the pot core inductive device of FIGS. 4–4*f*.
Figure 10A:
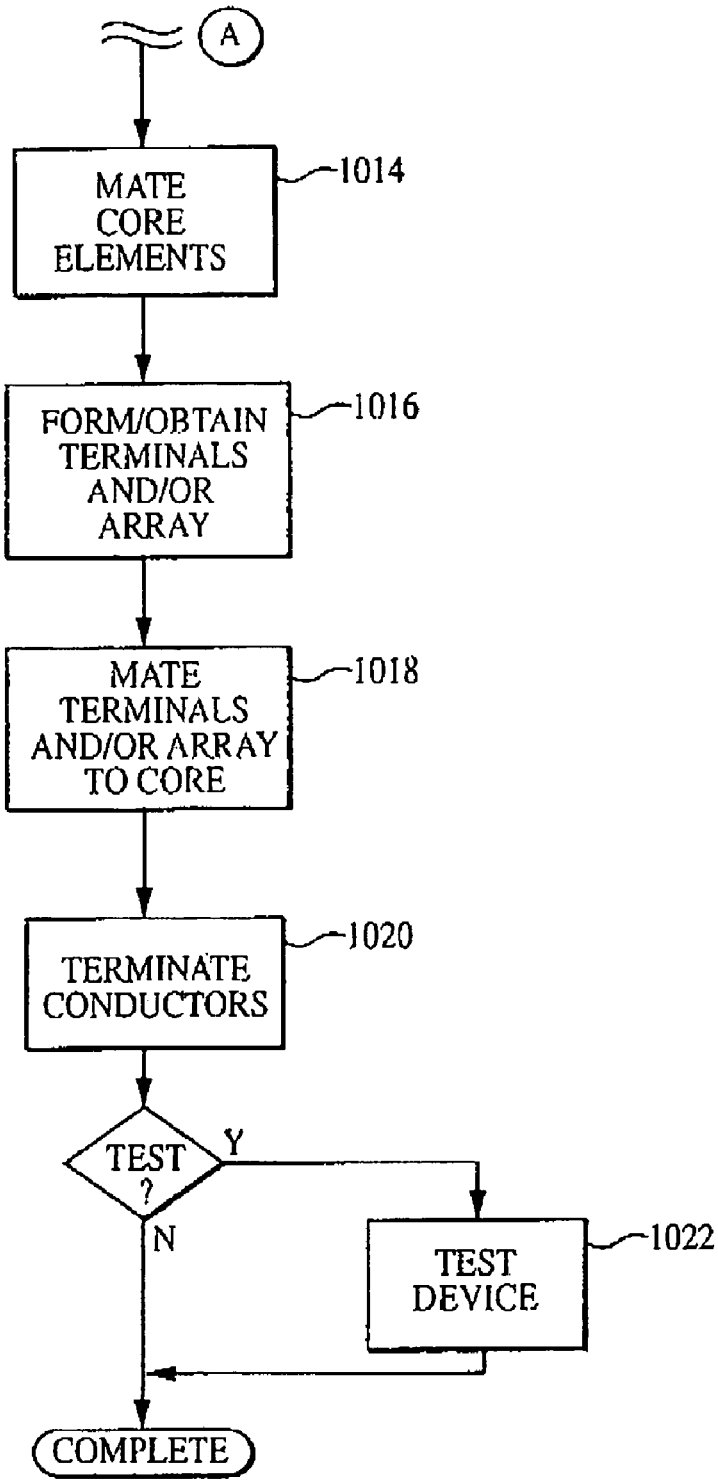
Figure 10B:
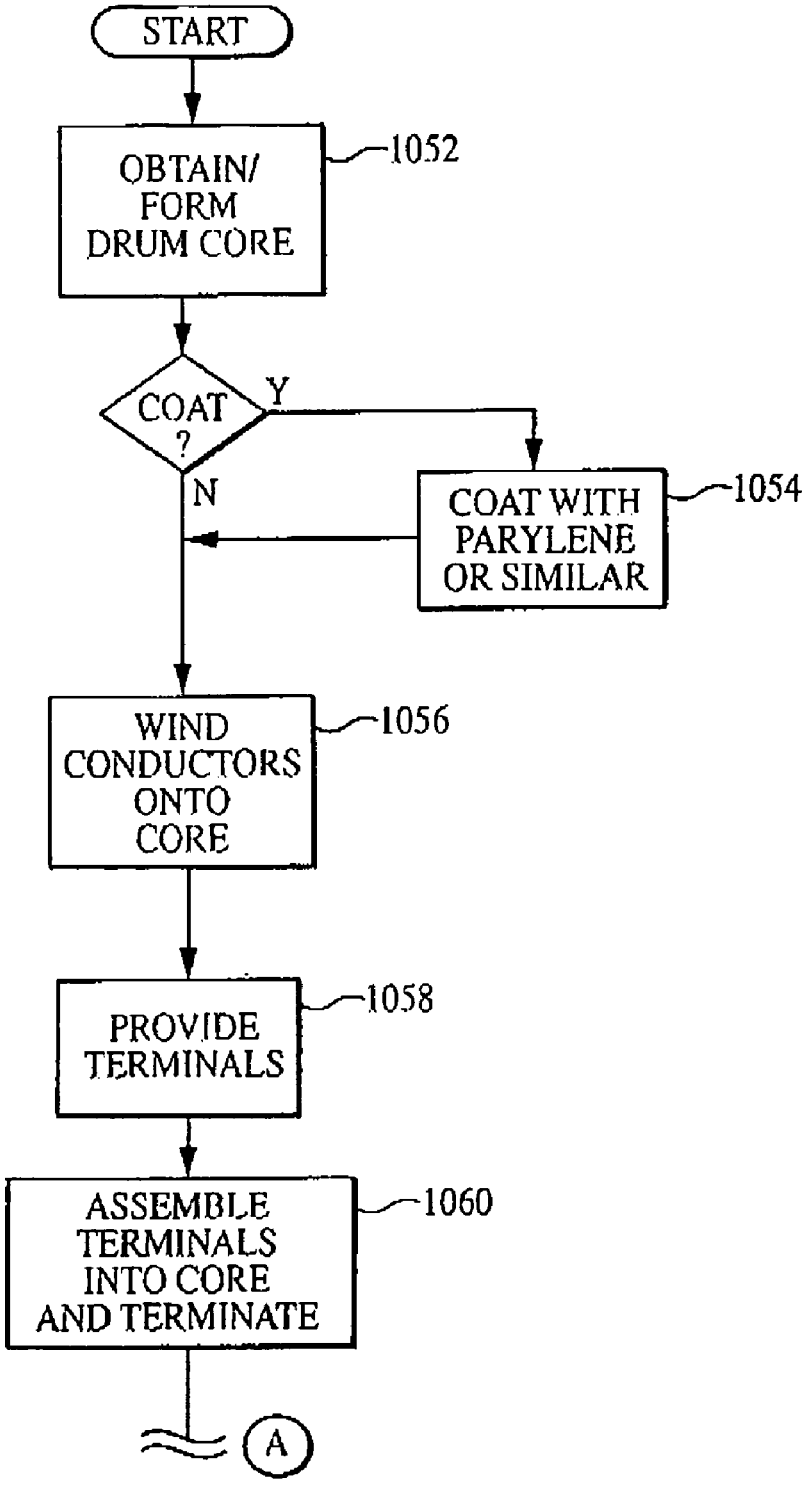
FIG. 10*b* is a logical flow diagram illustrating an exemplary method of manufacturing the drum core inductive devices of FIGS. 5–6.
Figure 10B:
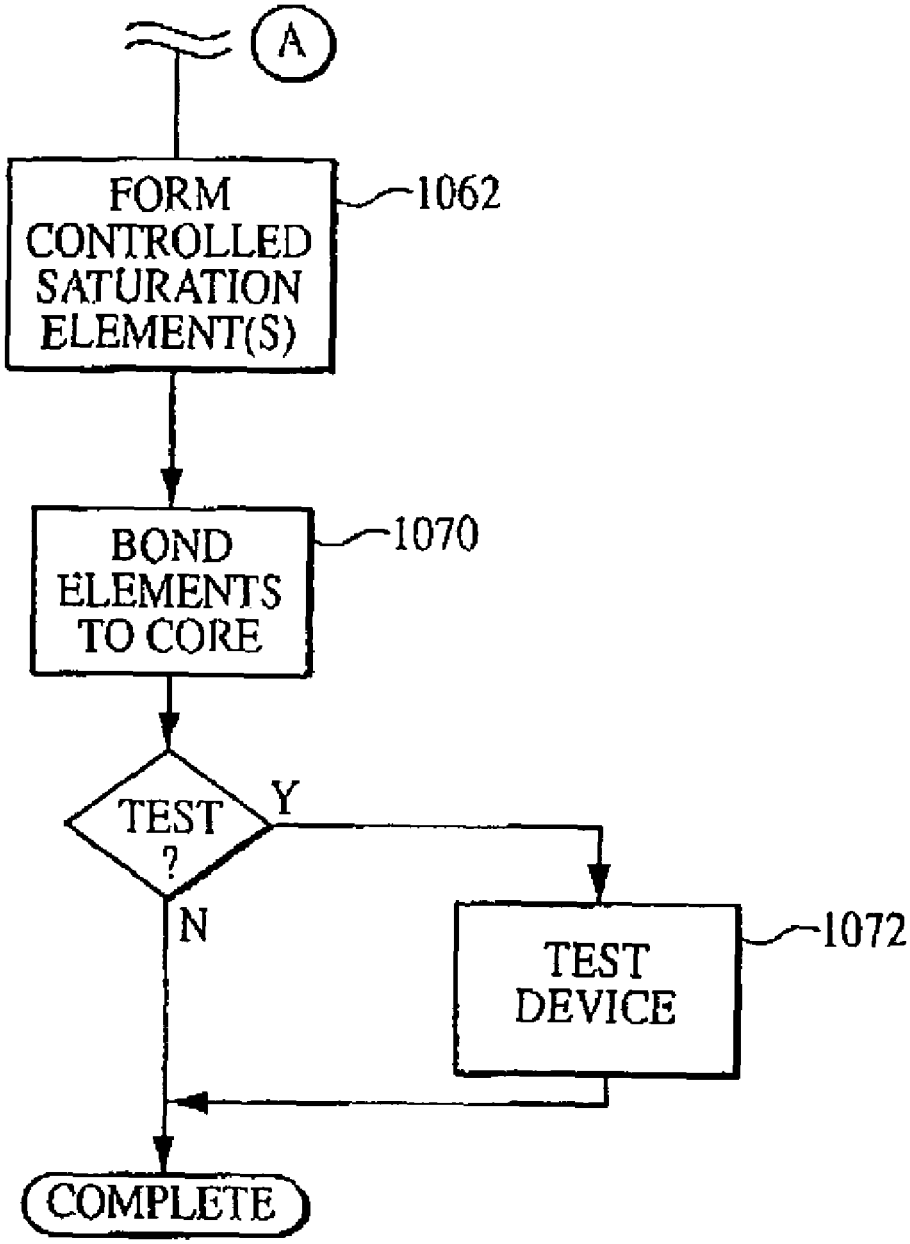

Referring now to FIGS. 10*a* and 10*b*, methods for manufacturing the inductive devices previously described herein are discussed in detail and illustrated in logical flow diagram form.

It will be recognized that while the following description is cast in terms of embodiments previously described herein (i.e., the pot core and drum-core devices), the method of the present invention is generally applicable to the various other configurations and embodiments of inductive device disclosed herein with proper adaptation, such adaptation being within the possession of those of ordinary skill in the electrical device manufacturing field.

Referring first to FIG. 10*a*, a method 1000 for manufacturing the improved pot core device of FIG. 4 is described. In a first step 1002 of the method 1000, the second element 402*b* of the pot core is obtained or manufactured. The core 402 of the exemplary device of FIG. 4 is preferably formed from a magnetically permeable material using any number of well understood processes such as material preparation, pressing, and sintering. The core 402 is produced to have specified properties including magnetic flux properties, cross-sectional shape and area, height, and post diameters, as is known in the art and accordingly not described further herein.

The first core element 402*a* may be formed directly with the variable geometry gap configuration previously described herein (step 1004), such as by making the mold or form used to fabricate the first core element 402*a* include the desired gap features. Alternatively, the first core element 402*a* can be formed per step 1006 effectively as a mirror image of the second element 402*b* (step 1007), and then processed (step 1008) to produce the desired variable geometry gap. Such processing per step 1008 includes in one embodiment machining at least a portion of the center post 406 of the first core element 402*a* to the desired configuration (e.g., the 90%/10% configuration with gap widths $W_1$ and $W_2$). Such machining comprises for example precisely grinding the desired portion of the core post 406 away. Alternatively, such processing may comprise micro-cutting or milling, or even cutting or ablation via laser energy as examples.

Next, per step 1010, the core elements 402*a*, 402*b* may be optionally coated on some or all surfaces with a layer of polymer insulation (e.g., Parylene) or other material, so as to protect the windings from damage or abrasion. This coating may be particularly useful when using very fine gauge windings or windings with very thin film coatings that are easily abraded during the winding process.

Next, the core is wound with the desired conductor configuration per step 1012. Such conductor configuration may comprise for example thin gauge magnet wire wound concentrically onto the center post 406 of the core in a substantially toroidal "donut" pattern, although other types of conductors (insulated or otherwise) and wind patterns may be used.

The two core elements 402 are next assembled and mated in their desired alignment using, for example, an adhesive compound (step 1014). The windings are captured within the recess formed within the core 402, with their free ends routed through the apertures 409 formed in the sides of the core elements 402 (or other comparable penetration).

The terminal array 425 and/or terminals 429 are next provided or fabricated per step 1016. The terminal array frame 427 is ideally formed using an injection or transfer molding process from a suitable polymer, although other materials and techniques may be substituted. The terminals 429 may include desired features such as notches for wire wrapping and substrate contact pads on their bottom ends, and be molded into or subsequently inserted into the frame 427. Fabrication of such terminal arrays is well known in the electronic arts, and accordingly not described further herein.

The wound core is next mounted to or fitted with a terminal array 425 of the type previously described herein per step 1018. For example, in the exemplary embodiment, the core 402 is adhered to the frame 427 of the terminal array using a bead or drop of suitable adhesive, such as an epoxy.

The windings are next terminated to the terminals 429 using, for example, a soldering process over a wire-wrap into notches formed in the terminal ends (step 1020).

The assembled inductive device 400 is then optionally tested per step 1022, thereby completing the manufacturing process.

Referring next to FIG. 10*b*, a method 1050 for manufacturing the improved drum core device(s) of FIGS. 5 and 6 is described, with specific reference to the single-spool core of FIG. 5 for sake of simplicity. In a first step 1052 of the method 1050, a drum core is obtained or manufactured. The core 502 of the exemplary device of FIG. 5 is preferably formed from a magnetically permeable material using any number of well understood processes such as material preparation, pressing, and sintering. The core 502 is produced to have specified properties including magnetic flux properties, cross-sectional shape and area, height, and post diameters, as is known in the art and accordingly not described further herein.

Next, per step 1054, the core 502 may be optionally coated on some or all surfaces with a layer of polymer insulation (e.g., Parylene) or other material so as to protect the windings from damage or abrasion.

Next, the core is wound with the desired conductor configuration per step 1056. Such conductor configuration may comprise for example thin gauge magnet wire wound concentrically onto the spool region of the core in a substantially helical lay pattern, although other types of conductors (insulated or otherwise) and wind patterns may be used.

The terminal 529 are next provided or fabricated per step 1058. As previously stated, the terminals 429 may include desired features such as notches for wire wrapping and substrate contact pads on their bottom ends. Fabrication of such terminals is well known in the electronic arts, and accordingly not described further herein.

The terminals 529 are next inserted into or bonded to the wound core 502 per step 1060. For example, in the exemplary embodiment, the terminals 529 are adhered to the grooves 535 of the core 502 a bead or drop of suitable adhesive, such as an epoxy. The windings are terminated to the terminals 529 during step 1060 by routing their free ends into the grooves 535 and under the terminals 529, thereby forming electrical contact therewith. Other method such as wire-wrapping and soldering (consistent with the chosen terminal configuration) may be used in addition or as an alternative.

Next, per step 1062, the controlled saturation element(s) 508 is/are fabricated. In the exemplary embodiment of FIG. 5, the element 508 comprises Ni—Fe tape. This tape is manufactured by first forming a sheet of Ni—Fe alloy in the desired thickness (step 1064). One side of the sheet is then impregnated with a suitable aggressive adhesive (or alternatively an epoxy-based adhesive) per step 1066, and the sheet perforated into strips of appropriate size using cutting machinery per step 1068.

One or more of the strips 508 obtained from step 1062 above are next affixed to the core 502 longitudinally along its axis in step 1070 so as to bridge the air gap between the two end elements 502*a*, 502*b*. Such attachment may be by automated means (e.g., a machine adapted to accurately place the element 508 to the core 502), or manually.

The assembled inductive device 500 is then optionally tested per step 1072, thereby completing the manufacturing process.

Alternatively, in the embodiment of the drum-core device using a continuous sheet of Ni—Fe or similar alloy, the aforementioned process may be modified such that the sheet of appropriate size is cut and then applied to the core 502. The heat-shrink sleeve or tubing (if used) is then applied at least to the peripheral regions of the end flanges of the core, overlying the controlled saturation sheet 508, and then exposed to sufficient heat to shrink the sleeve to tightly bond the sheet 508 to the drum core flanges.

Figure 11:
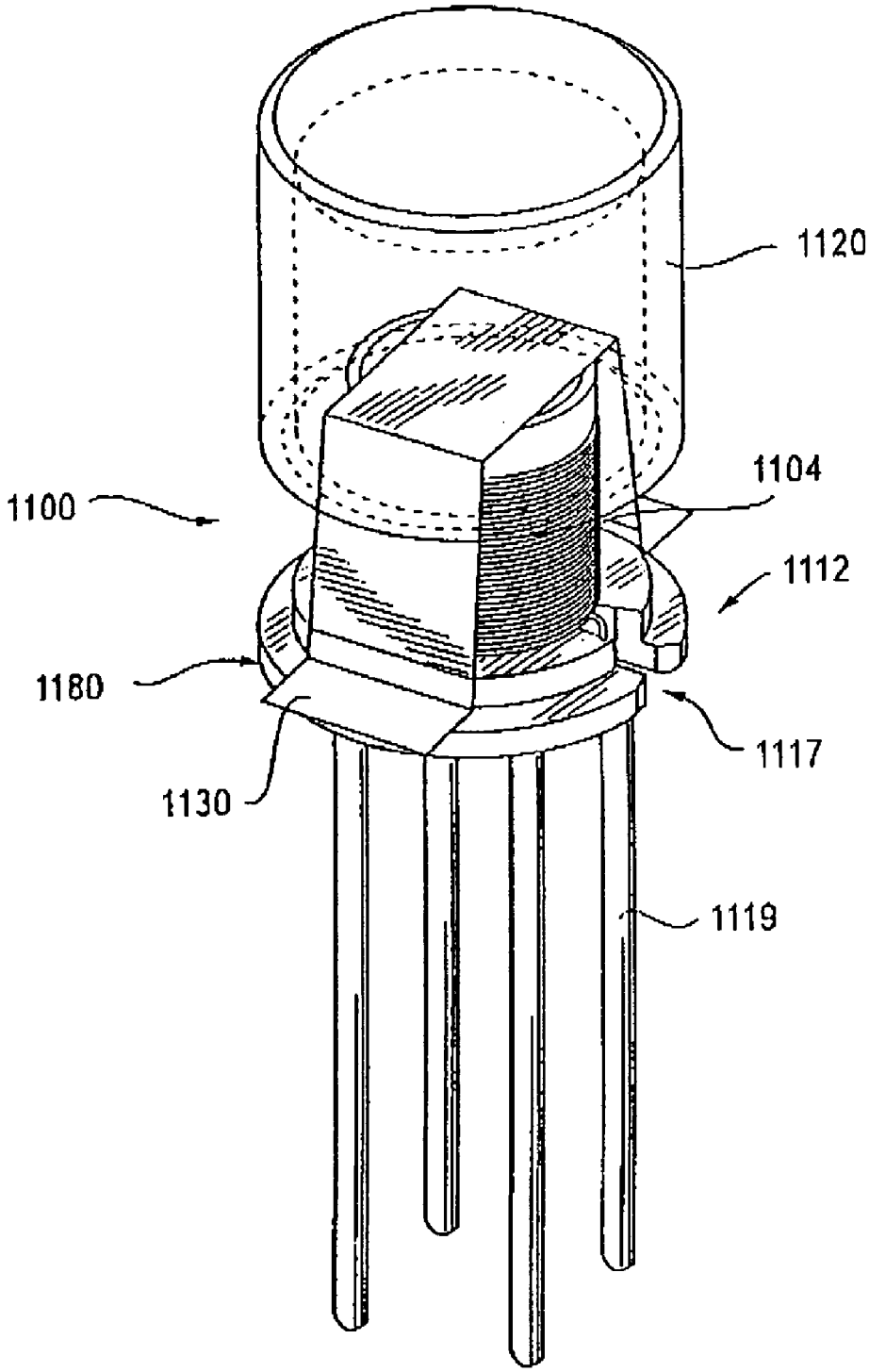
FIG. 11 is a top perspective, partially exploded view of a first exemplary embodiment of a controlled induction device according to the invention FIG. 11*a* a is a side cross-sectional exploded view of the device of FIG. 11.
Figure 11A:
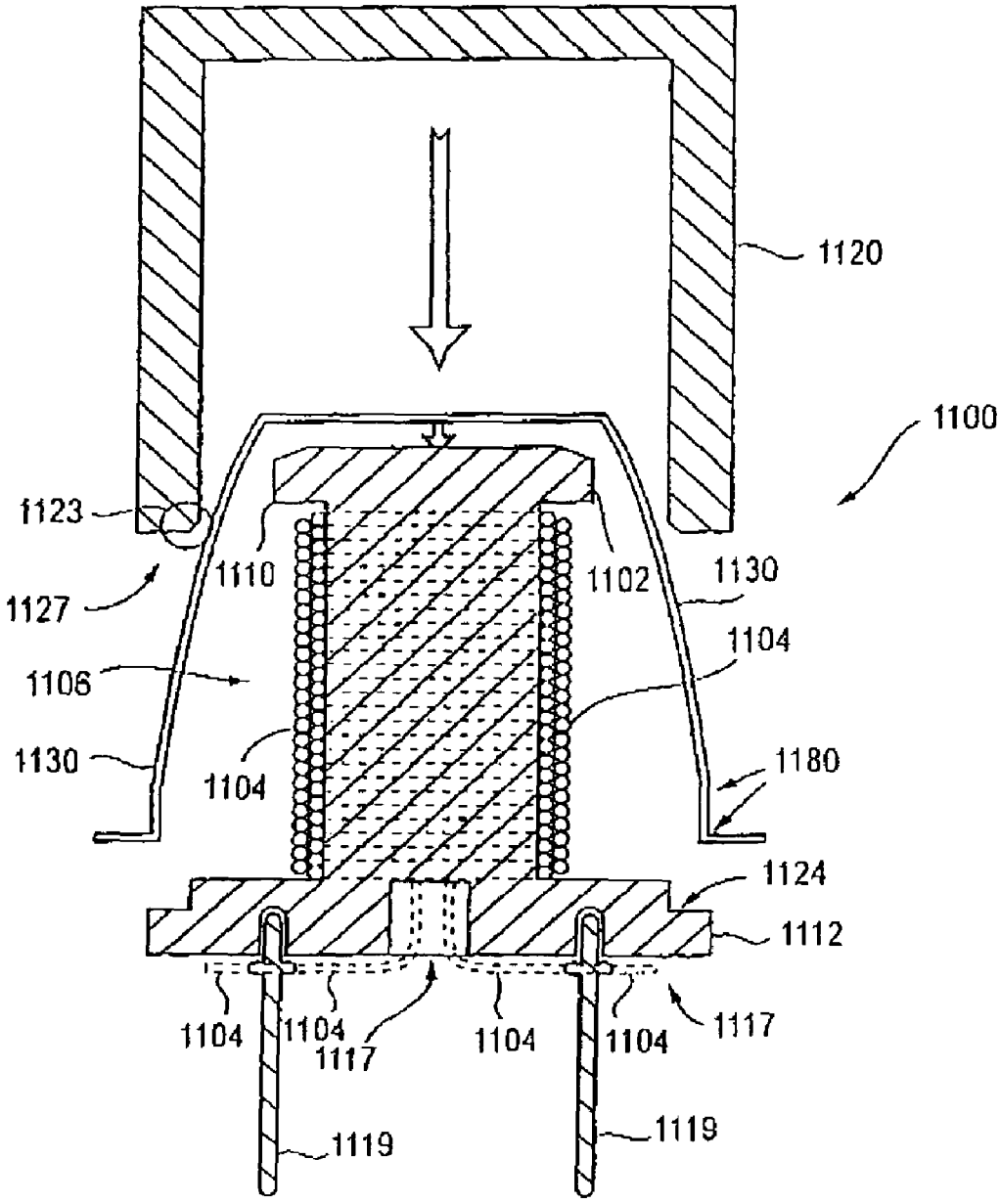
FIG. 11*b* is a top plan view of another embodiment of the controlled inductance element of the invention, showing the varying strip width.
FIG. 11*c* is an exploded perspective view of another embodiment of the controlled inductance device, having a plurality of inductance elements.

Referring now to FIGS. 11 and 11*a*, another embodiment of the controlled inductance device according to the present invention is disclosed. In the embodiment of FIGS. 11 and 11*a*, the device 1100 comprises a substantially "drum" shaped magnetically permeable core element 1102 and a bifilar winding 1104 of the type well known in the electrical component arts which is disposed on (wound onto) the core element 1102 around the latter's central portion 1106. The core element of the illustrated embodiment is substantially asymmetric from the standpoint that the diameter of the upper core flange 1110 is different (here, smaller) that that of the base portion flange 1112. In this embodiment, the upper flange 1110 is approximately 0.256 in. (6.52 mm) in diameter, while the lower flange 1112, inside the lip 1124, is approximately 0.346 in. (8.79 mm) in diameter, although other values may be selected. The core element 1102 of the present embodiment is formed from a ferrite material, although it will be recognized that other materials (MN—Zn, etc.) may be used. A plurality of apertures 1117 or perforations are formed in the base flange 1112 as well, thereby permitting the routing of the bifilar conductors outside the interior volume of the device 1100 for ultimate bonding (e.g., soldering) with the conductive terminals 1119 disposed within the base of the core element 1102. The conductive terminals 1119 are bonded into recesses (not shown) formed in the underside of the base flange 1112, such as using adhesive (e.g., ferrite adhesive) or potting compound. Other configurations for these terminations may also be used, as will be recognized and implemented by those of ordinary skill. Routing the leads outside the interior volume makes the device more easily manufactured, although it will be recognized that other configurations (including terminations within the interior volume of the device 1100) may be used if desired consistent with the present invention.

A substantially cylindrical cap (shield) element 1120 is disposed substantially around the majority of the winding 1104 and core element 1102, the cap 1120 being sized to mate with a lip or edge 1124 formed in the upper surface of the base portion flange 1112. Hence, the cap 1120 in effect rests on the lip 1124 of the flange 1112 when the two components are assembled. The interior edge 1123 of the cap mating surface 1127 is in the illustrated embodiment chamfered such that a progressively narrowing gap is formed around the periphery of the base flange 1112, although such chamfer is not required in practicing the invention.

The cap 1120 further provides significant benefits in terms of shielding; e.g., shielding external electronic components proximate the device 1100 from EMI generated within the device 1100 during operation. This shielding effect results largely from the cap 1120 channeling or forcing the air gap within the interior volume of the cap. In the illustrated embodiment, the cap is approximately 0.067 in. (1.7 mm) thick, although other values may be used.

The cap 1120 is ultimately bonded to the base flange 1112 using, e.g., an adhesive or even soldering. However, before the cap 1120 is bonded onto the core element 1102, a controlled inductance element 1130 is disposed between the cap 1120 and the base of the core element 1102 such that the controlled inductance element 1130 is "pinched" between the two components at least at two different locations around the periphery of the base flange 1112; i.e., within the aforementioned progressively narrowing gap.

Figure 11B:
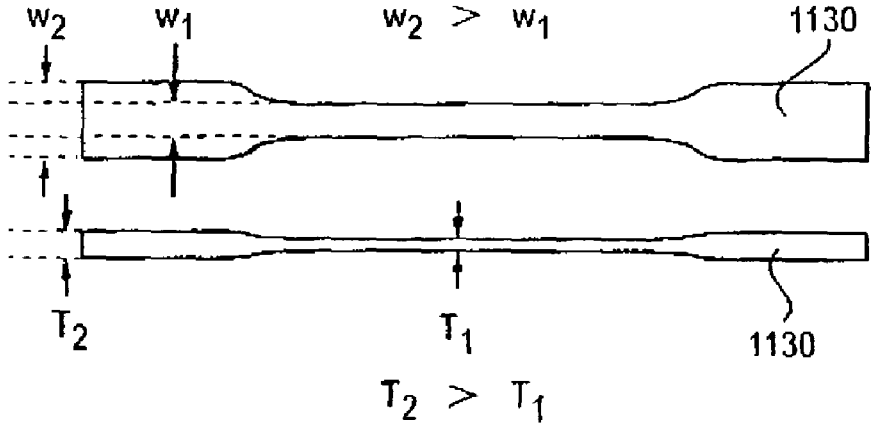
Figure 11C:
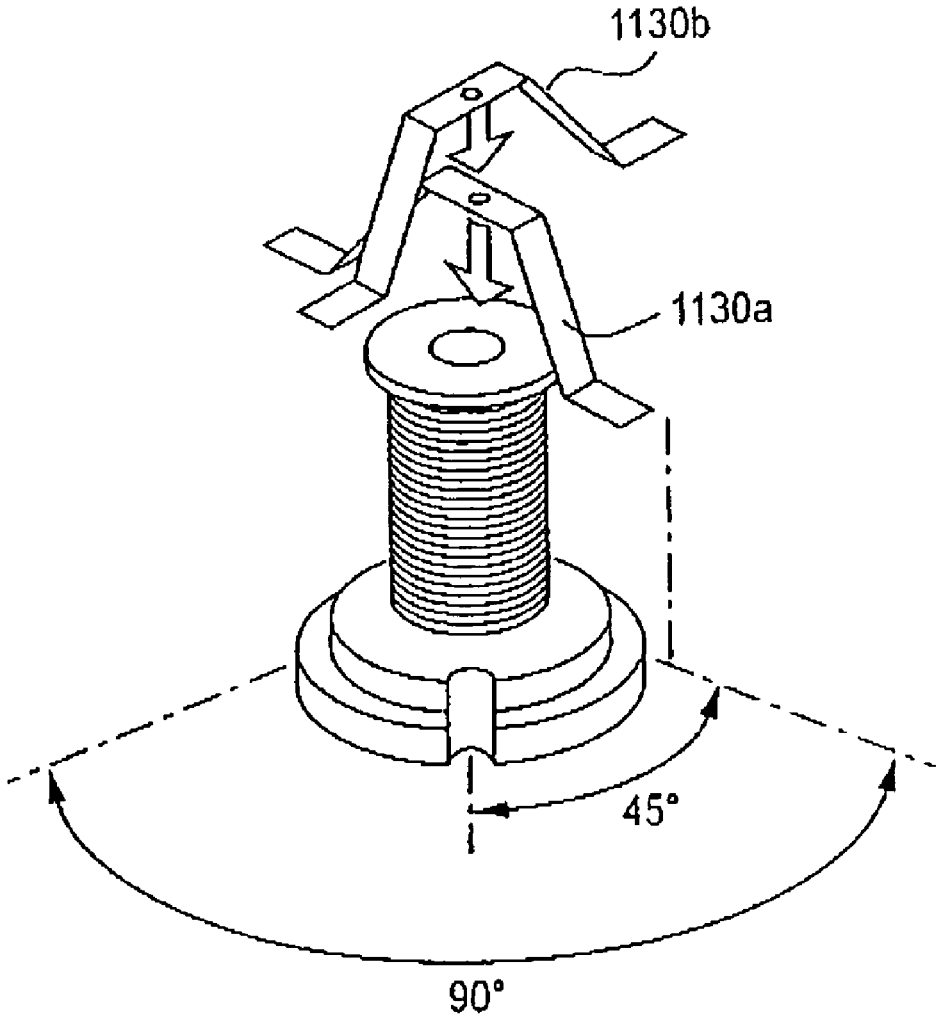

In the illustrated embodiment, the controlled inductance element 1130 comprises a nickel (Ni) alloy strip having a predetermined thickness (e.g., in the range of 0.001–0.005 in., although other values may be used). The width of the strip 1130 is also controlled to a desired value (here, approximately 5.08 mm (0.200 in.)) although it will be recognized that different combinations of width and thickness of the strip may be used to provide the desired electrical and inductive properties for the device 1100. As will be understood, increased width and/or thickness increases the current-carrying capacity of the strip 1130 before it becomes saturated. Furthermore, the strip 1130 may have a non-uniform or varied width and/or thickness as a function of its length, as shown in FIG. 11*b*. Such shapes may provide desired benefits in the current/saturation characteristic of the strip 1130 due to, for example, eddy currents or surface effects generated within the material. It may also comprise a plurality of smaller strips 1130*a*, 1130*b*, such as shown in FIG. 11*c*. Myriad different configurations for providing a controlled inductance (whether "strip" based or otherwise) may be used consistent with the invention. The single uniform strip shown in the embodiment of FIG. 11, however, has been found by the Assignee hereof to provide the best confluence of desirable features; i.e., low cost, good electrical properties, and ease of manufacturing (both of the strip and the device as a whole), especially since the strip.

During manufacture, the strip 1130 is disposed symmetrically across the top of the upper flange 1110 of the core element (and deformed as required), such that it drapes down the sides of the core element central portion to at least the level of the base flange 1112. A bead of silicone or adhesive can also optionally be used to maintain the position of the strip 1130 with respect to the core element 1102. Hence, when the cap element 1120 is placed over the top of the core 1102, the downward-draping portions of the strip 1130 are frictionally captured at their distal ends between the inner edge of the cap 1120 and the base flange 1112, thereby tending to add tension to the strip 1130 as the cap 1120 is slid into its final resting position. Two sets of bends 1180 are optionally placed in the distal portions of the strip 1130 so as to facilitate easier mating with the flange 1112 and the cap 1120 at assembly.

In another alternative embodiment, the inductance element(s) 1130 may be pre-formed and adhered or otherwise disposed within the shield or cap 1120 such that it is properly placed when the cap 1120 is disposed over the wound core element 1102.

It will be recognized that the inductive device 1100 of FIG. 11 can have a variety of different uses including for example providing an increased inductance and reduced notch frequency in the tuned portion of an elliptical filter such as those previously described herein. Such performance allows the improved device 1100 to comply with more stringent or demanding specifications which prior art devices are unable to comply with (at least at the same level of performance, simplicity, and low cost provided by the present invention), such as the aforementioned ETSI TS 952-1-5 standard.

Figure 12:
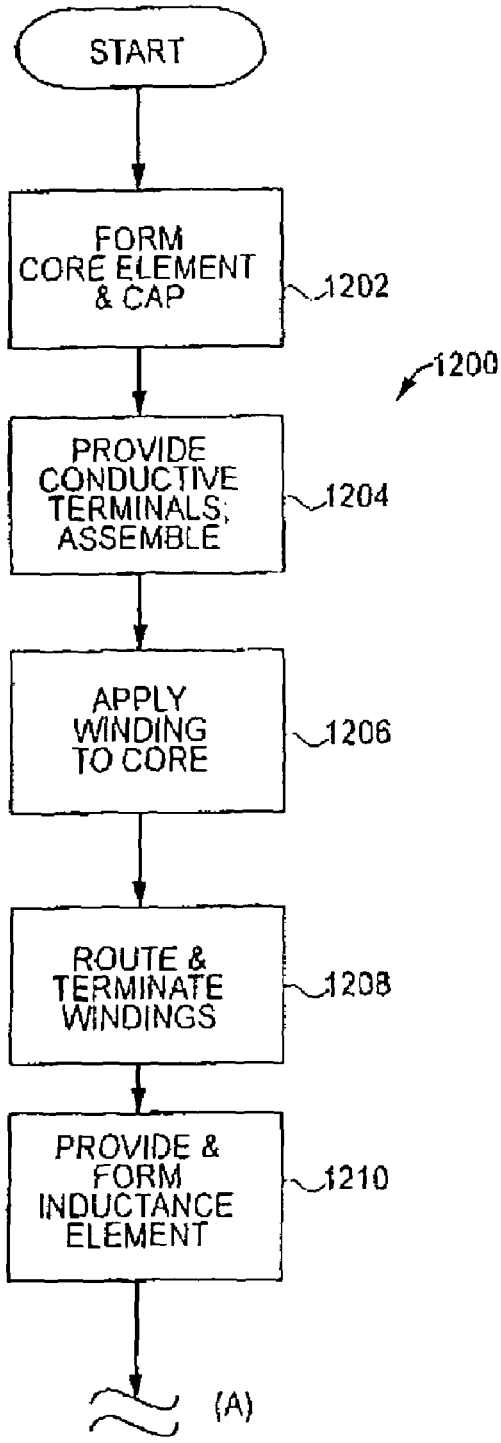
FIG. 12 is a logical flow diagram illustrating an exemplary embodiment of the method of manufacturing the device of FIG. 11.
Figure 12:
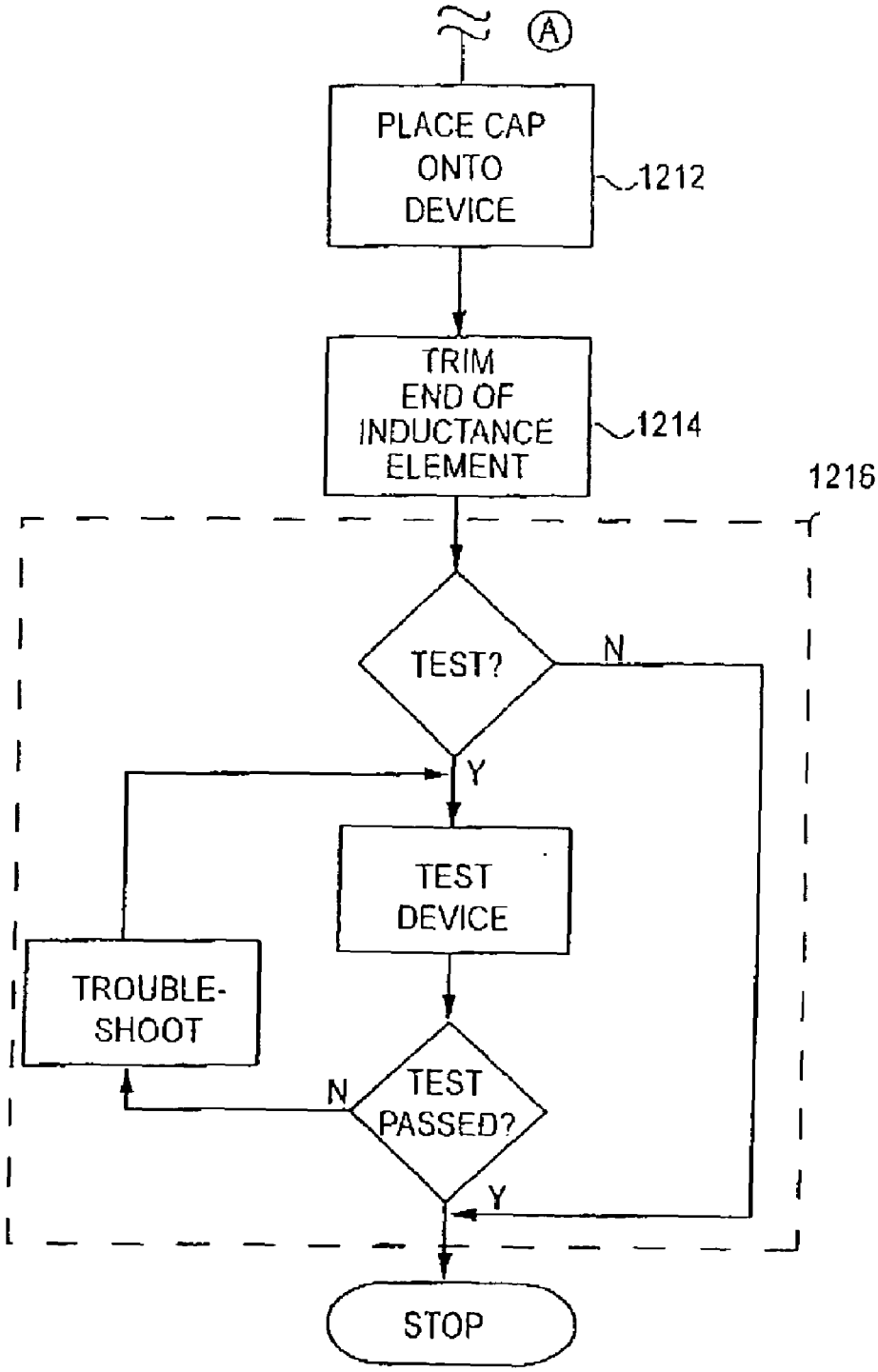

Referring now to FIG. 12, one exemplary embodiment of the methodology of manufacturing the device 1100 of FIG. 11 is described. As shown in FIG. 12, the method 1200 comprises first providing the core element 1102 and cap 1120 (step 1202), both being formed of the same (or similar) magnetically permeable material such as ferrite. Formation of these types of components is well known, and accordingly not described further. As part of the formation process, two or more apertures 1117 are formed in the base flange 1112 as previously discussed, as well as four (4) recesses for the terminations 1119.

Next, in step 1204, the conductive terminals 1119 are provided and disposed within the aforementioned recesses. These may be frictionally received, adhered using epoxy or glue, or otherwise bonded to the core element if desired to increase mechanical rigidity.

Next, in step 1206, the (bifilar) winding is wound around the central portion of the core element 1102 in a layered fashion to the desired depth/length. The free ends of the winding are stripped free of any insulation as part of this step, thereby facilitating subsequent termination of the winding(s) to their respective terminals 1119.

The free (stripped) ends of the windings are next routed through the apertures and down to the terminals 1119, where they are electrically terminated thereto (step 1208). Such termination may comprise soldering, epoxy bonding, wire wrapping, brazing, or similar, or any combination thereof.

Next, per step 1210, the inductance element (strip) 1130 is provided and formed to shape over the top flange 1110 of the core element 1102, such that the distal ends hang down lengthwise along the core as shown in FIG. 11. As discussed above, adhesive or silicone may optionally be used to maintain the positioning of the strip 1130.

The cap 1120 is next fitted over the top of the device 1100, and slid downward to engage the base flange 1112 as previously described (step 1212). This captures the distal ends of the strip 1130 between the two components 1120, 1112, with excess length of the strip in effect "hanging out" at the gap formed between these components. The cap may also be glued (e.g., using so-called "ferrite glue") or otherwise bonded to the core element 1102 if desired to aid in maintaining the position of the components, although other techniques may be substituted, such as designing the components with sufficiently close tolerance such that frictional engagement is sufficient to keep the components 1120, 1102 together.

Finally, per step 1214, the distal ends of the strip 1130 are trimmed effectively flush with the cap sidewall. The device is also optionally tested (step 1216) if desired.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A controlled inductance device for use in an electrical circuit, comprising:

magnetically permeable core, said core comprising a substantially right cylindrical shape and having upper and lower core elements that meet substantially at a first plane intersecting said right cylindrical shape and forming an internal channel adapted to accommodate at least one winding, said upper and lower elements each having a central, substantially cylindrical portion, the mating surface of the portion of one of said upper and lower elements being substantially planar, the mating surface of the portion of the other of said elements being substantially stepped so as to form a stepped gap with said planar mating surface;

at least one winding disposed substantially within said internal channel; and a terminal array having a plurality of terminals in electrical communication with said at least one winding, said array being configured for mounting said inductance device to respective ones of conductive elements of a substrate;

wherein said controlled inductance device produces an inductance-current profile having (i) a first portion with a substantially constant first inductance value corresponding to low dc current through said device), (ii) a second substantially vertical portion with decreasing inductance as dc current increases, (iii) a third portion with substantially constant second inductance value at higher dc current, and (iv) a fourth portion wherein said device core is completely saturated.

2. The controlled inductance device of claim 1, wherein said first inductance value comprises a value greater than 25 mH, and said second value comprises a value less than 10 mH.

3. The controlled inductance device of claim 2, wherein said second substantially vertical portion of said profile occurs at dc current values less than 15 mA, and said fourth portion occurs at current values greater than 150 mA.

4. The controlled inductance device of claim 1, wherein said second substantially vertical portion of said profile occurs at dc current values less than 15 mA, and said fourth portion occurs at current values greater than 150 mA.

5. The controlled inductance device of claim 1, wherein said stepped gap comprises two discrete gaps of different gap width.

6. The controlled inductance device of claim 5, wherein said two discrete gaps are created by respective step regions that are substantially concentric with one another.

7. The controlled inductance device of claim 6, wherein the outer one of said two discrete concentric gaps comprises a plurality of individual punctuated gaps disposed at respective angles along the outer circumference of said stepped mating surface.

8. The controlled inductance device of claim 1, wherein said stepped gap comprises three discrete gap values.

9. A DSL filter circuit specifically adapted to comply with the requirements of an electrical performance standard, comprising:

at least one shielded inductive device comprising:

a substantially cylindrical core;

at least one winding disposed substantially around said core;

a shield cap adapted to cover substantially all of said at least one winding and said core; and at least one inductance control element;

wherein said device provides at least first and second inductance values corresponding to first and second predetermined notch frequencies.

10. The circuit of claim 9, wherein said standard comprises the ETSI TS 952-1-5 standard.

11. The circuit of claim 9, wherein said at least one inductance control element comprises a substantially planar strip of metal deformed into a shape having a plurality of segments, a plurality of said plurality of segments being disposed between said core and said shield cap and in contact with both said core and shield cap.

12. A DSL filter circuit specifically adapted to comply with the requirements of an electrical performance standard, comprising:

at least one shielded inductive device comprising:

a substantially cylindrical core;

at least one winding disposed substantially around said core;

a shield cap adapted to cover substantially all of said at least one winding and said core; and at least one inductance control element;

wherein said device provides an enhanced inductance and reduced notch frequency in a predetermined portion of the inductance profile of said circuit.

13. The circuit of claim 12, wherein said at least one inductance control element comprises a substantially planar strip of metal deformed into a shape having a plurality of segments, a plurality of said plurality of segments being disposed between said core and said shield cap and in contact with both said core and shield cap.

14. The circuit of claim 13, wherein said standard comprises the ETSI TS 952-1-5 standard.

15. An inductive device, comprising:

a magnetically permeable and substantially drum-shaped core having at least one spool region and at least first and second end elements proximate to said spool region;

a controlled saturation element cooperating with said core to provide said inductive device with a desired inductance characteristic, wherein said controlled saturation element comprises a substantially continuous sheet of alloy disposed at least partly around the peripheries of both said first and second end elements; and at least one shroud disposed around at least a portion of said sheet, said at least one shroud adapted to maintain said sheet and said core in substantially fixed relationship.

16. The inductive device of claim 15, wherein said desired inductance characteristic comprises at least a first response region having a first substantially constant inductance at a first current, and a second response region having a second substantially constant inductance at a second current, said first inductance being substantially higher than said second inductance.

17. The inductive device of claim 16, wherein said first and second response regions are separated by a third region characterized by a large decrease in inductance with a comparatively small increase in current.

18. The inductive device of claim 15, wherein said desired inductance characteristic comprises an inductance-current profile having (i) a first portion with a substantially constant first inductance value corresponding to low dc current through said device, (ii) a second substantially vertical portion with decreasing inductance as dc current increases, (iii) a third portion with substantially constant second inductance value at higher dc current, and (iv) a fourth portion wherein said device core is completely saturated.

19. The inductive device of claim 17, wherein said at least one shroud comprises heat-shrink tubing.

20. The inductive device of claim 15, wherein said alloy comprises at least iron and nickel.

21. The inductive device of claim 15, wherein the thickness of said alloy is selected so as to create one or more artifacts within the inductance-current characteristic of said device.

22. The inductive device of claim 15, wherein said core comprises first and second spool regions disposed longitudinally along said device between said first and second end elements, and a central element disposed between said first and second spool regions.

23. The inductive device of claim 15, wherein said controlled saturation element is adapted to allow saturation of at least part of said core at higher current values.

24. The inductive device of claim 19, wherein said desired inductance characteristic comprises at least a first region having a first substantially constant inductance at a first current, and a second region having a second substantially constant inductance at a second current, said first inductance being substantially higher than said second inductance.

25. The inductive device of claim 19, wherein said first and second inductance regions are separated by a third region characterized by a large decrease in inductance with a comparatively small increase in current.

26. The inductive device of claim 25, wherein said alloy comprises at least an iron and nickel.

27. The inductive device of claim 19, wherein the thickness of said alloy is selected so as to create one or more artifacts within the inductance-current characteristic of said device.

28. The inductive device of claim 19, wherein said desired inductance characteristic comprises at least two regions having substantially constant yet different inductance values, separated by a region having a large negative change in inductance with increasing dc current.

29. The inductive device of claim 15, wherein said at least one inductive device is adapted for use in a DSL filter circuit.

30. The inductive device of claim 29, wherein said desired inductance characteristic produces a higher inductance during an on-hook state of said circuit, and a lower inductance during an off-hook state of said circuit.

31. The inductive device of claim 29, wherein said DSL filter circuit comprises a dynamically switched filter circuit adapted to reduce shunt capacitance when combined with other filter circuits on the same telecommunications line.

32. A DSL filter circuit, comprising:

an inductive device having a magnetically permeable and substantially drum-shaped core having at least one spool region and at least first and second end elements proximate said spool region;

a controlled saturation element cooperating with said core to provide said inductive device with a desired inductance characteristic, wherein said controlled saturation element comprises a substantially continuous layer of alloy disposed at least partly around the peripheries of both said first and second end elements;

at least one shroud disposed around at least a portion of said layer, said at least one shroud adapted to maintain said layer and said core in substantially fixed relationship; and a dynamic filter circuit;

wherein said inductive device and said filter circuit cooperate to provide an on-hook impedance of a first value, and off-hook impedance of a second value, said second value being lower than said first value.

33. The DSL circuit of claim 32, wherein said substantially continuous layer of alloy is formed from at least nickel (Ni).

34. The DSL circuit of claim 32, wherein said DSL circuit provides a reduced shunt capacitance and increased stop band during operation.

35. An inductive device, comprising:

at least one magnetically permeable and substantially drum-shaped core means having at least one spool region and at least first and second raised elements proximate said spool region;

at least one means for conducting electrical current disposed proximate to said core means;

at least one means for controlling saturation of said core means, said means for controlling cooperating with said core means to provide said inductive device with a substantially stepped inductance characteristic, said means for controlling further comprising a substantially continuous layer of alloy disposed at least partly around the peripheries of both said first and second raised elements; and at least one shrouding means disposed around at least a portion of said sheet of alloy, said at least one shrouding means adapted to maintain said sheet and said core means in a substantially fixed relationship.

36. The inductive device of claim 35, wherein said at least one shrouding means comprises a substantially cylindrical cap element.

37. The inductive device of claim 35, wherein said first and second raised elements comprise first and second flanges, respectively, the first flange being larger in diameter than the second flange.

38. The inductive device of claim 35, wherein said substantially stepped inductance characteristic comprises a first inductance value greater than 25 mH, and a second value less than 10 mH.

39. The inductive device of claim 38, wherein said substantially stepped characteristic further comprises a substantially vertical portion occurring at dc current values less than 15 mA.

40. A DSL filter circuit specifically adapted to comply with the requirements of an electrical performance standard, comprising:

at least one shielded inductive device comprising:

a magnetically permeable and substantially drum-shaped core having at least one spool region and at least first and second elements proximate said spool region;

a controlled saturation element cooperating with said core to provide said inductive device with a desired inductance characteristic, wherein said controlled saturation element comprises a layer of alloy disposed at least partly around the peripheries of both said first and second end elements; and at least one cap element disposed around at least a portion of said layer, said at least one cap element adapted to maintain said layer and said core in substantially fixed relationship;

wherein said device provides at least first and second inductance values corresponding to first and second predetermined notch frequencies.

41. The circuit of claim 40, wherein said standard comprises the ETSI TS 952-1-5 standard.

42. The circuit of claim 40, further comprising at least one inductance control element comprises a substantially planar strip of metal deformed into a shape having a plurality of segments, a plurality of said plurality of segments being disposed between said core and said cap element and in contact with both said core and cap element.

43. The circuit of claim 40, wherein said substantially continuous sheet of alloy comprises at least nickel (Ni).

* * * * *